US008418628B2

(12) United States Patent
Okubo et al.

(10) Patent No.: US 8,418,628 B2
(45) Date of Patent: Apr. 16, 2013

(54) LOW FLOOR VEHICLE

(75) Inventors: Yoshiki Okubo, Mihara (JP); Hiroyuki Kono, Hiroshima (JP); Kousuke Katahira, Kawasaki (JP)

(73) Assignee: Mitsubishi Heavy Industries, Ltd, Tokyo (JP)

( * ) Notice: Subject to any disclaimer, the term of this patent is extended or adjusted under 35 U.S.C. 154(b) by 0 days.

(21) Appl. No.: 13/148,372

(22) PCT Filed: Jun. 16, 2009

(86) PCT No.: PCT/JP2009/060912

§ 371 (c)(1),
(2), (4) Date: Oct. 28, 2011

(87) PCT Pub. No.: WO2010/095285

PCT Pub. Date: Aug. 26, 2010

(65) Prior Publication Data

US 2012/0037031 A1 Feb. 16, 2012

(30) Foreign Application Priority Data

Feb. 20, 2009 (JP) ..... 2009-037991

(51) Int. Cl.
*B61F 3/00* (2006.01)

(52) U.S. Cl.
USPC ..... 105/182.1; 105/185

(58) Field of Classification Search ..... 105/72.2, 105/182.1, 167, 215.2, 215.1, 158.2, 185, 105/34.1
See application file for complete search history.

(56) References Cited

U.S. PATENT DOCUMENTS 2,030,311 A * 2/1936 Messick ..... 105/215.2
2,039,489 A * 5/1936 Messick ..... 105/215.2
2,140,421 A * 12/1938 Fageol ..... 105/72.2
3,333,551 A * 8/1967 Pelz et al. ..... 105/183
(Continued)

FOREIGN PATENT DOCUMENTS

JP 39-17470 B2 8/1964
JP 60-121171 A 6/1985
(Continued)

OTHER PUBLICATIONS

JP Office Action for 2009-037991 dated Sep. 2, 2011.
(Continued)

*Primary Examiner* — Jason C Smith
(74) *Attorney, Agent, or Firm* — Lowe Hauptman Ham & Berner, LLP

(57) ABSTRACT

A the low floor vehicle includes a journal member which couples a pair of wheels and is attached to a truck frame; and a truck frame lateral beam arranged along a vehicle width direction closer to the center of the truck frame than the journal member. The journal member is turnable with respect to the struck frame. A pair of left and right stub links extending between the journal member and the truck frame lateral beam, are provided. Axes passing both ends of the pair of stub links are arranged to tilt so as to widen a space between the ends in the vehicle width direction with going from the truck frame lateral beam toward the journal member. Both the ends of the stub links are attached to be pivotable respectively around axes which extend in a height direction to the journal member and the truck frame lateral beam.

3 Claims, 14 Drawing Sheets

U.S. PATENT DOCUMENTS

| | | | | | |
|---|---|---|---|---|---|
| 3,665,865 | A | * | 5/1972 | Pelz | 105/183 |
| 4,134,343 | A | * | 1/1979 | Jackson | 105/167 |
| 4,258,629 | A | * | 3/1981 | Jackson et al. | 105/167 |
| 4,480,553 | A | * | 11/1984 | Scheffel | 105/167 |
| 4,537,137 | A | * | 8/1985 | White, Jr. | 105/72.2 |
| 5,086,706 | A | * | 2/1992 | Boivin | 105/168 |
| 5,107,773 | A | * | 4/1992 | Daley et al. | 105/185 |
| 5,211,116 | A | * | 5/1993 | Schneider | 105/168 |
| 5,372,073 | A | * | 12/1994 | Cattani | 105/3 |
| 5,448,953 | A | * | 9/1995 | Bieker et al. | 105/158.2 |
| 5,586,507 | A | * | 12/1996 | Madison et al. | 105/215.2 |
| 6,250,232 | B1 | * | 6/2001 | Hachmann et al. | 105/197.05 |
| 6,601,520 | B2 | * | 8/2003 | Eche et al. | 105/34.1 |
| 6,910,426 | B2 | * | 6/2005 | Krishnaswami | 105/167 |
| 2001/0051746 | A1 | * | 12/2001 | Hagihara et al. | 562/400 |
| 2002/0195018 | A1 | * | 12/2002 | Eche et al. | 105/158.2 |
| 2004/0149161 | A1 | * | 8/2004 | Krishnaswami | 105/167 |
| 2010/0083866 | A1 | * | 4/2010 | Rodet et al. | 105/34.1 |
| 2010/0132585 | A1 | * | 6/2010 | Rodet et al. | 105/133 |
| 2010/0294164 | A1 | * | 11/2010 | Oku et al. | 105/182.1 |
| 2011/0239899 | A1 | * | 10/2011 | Okubo et al. | 105/185 |
| 2012/0037031 | A1 | * | 2/2012 | Okubo et al. | 105/167 |
| 2012/0048139 | A1 | * | 3/2012 | Okubo et al. | 105/182.1 |
| 2012/0060719 | A1 | * | 3/2012 | Nishimura et al. | 105/182.1 |

FOREIGN PATENT DOCUMENTS

| | | | | |
|---|---|---|---|---|
| JP | 61-241259 | A | | 10/1986 |
| JP | 3-258656 | A | | 11/1991 |
| JP | 05-085358 | A | | 4/1993 |
| JP | 6-087446 | A | | 3/1994 |
| JP | 09-002263 | A | | 1/1997 |
| JP | 11509161 | A | | 8/1999 |
| JP | 2002-211392 | A | | 7/2002 |
| JP | 2006-103424 | A | | 4/2006 |
| JP | 2008-132828 | A | | 6/2008 |
| JP | 2008132828 | A | * | 6/2008 |
| JP | 2008162455 | A | | 7/2008 |

OTHER PUBLICATIONS

Japanese Notice of Allowance, dated May 11, 2012, in Application No. 2009-037991.

International Search Report for PCT/JP2009/060912 mailed Aug. 18, 2009.

* cited by examiner

LOW FLOOR VEHICLE

RELATED APPLICATIONS

The present application is a National Phase of International Application Number PCT/JP2009/060912, filed Jun. 16, 2009 and claims priority from, Japanese Application Number 2009-037991, filed Feb. 20, 2009.

TECHNICAL FIELD

The present invention relates to a low floor vehicle which travels on a track.

BACKGROUND ART

In recent years, streetcars and the like have adopted a low floor vehicle design in which a floor surface in the vehicle is set close to a road surface to reduce a difference in level of stepping up and stepping down for passengers so as to make the vehicles barrier-free. In such a streetcar, because of limitations such as road traffic conditions, a large number of curved tracks curving at a curvature radius equal to or less than 20 m, are provided. There is a problem in that, when the vehicle enters a curved track, an angle in a traveling direction of wheels with respect to a tangential direction of the curved track (hereinafter referred to as "attack angle") increases. When this attack angle is large, in wheels present on an outside rail during traveling on the curved track, in some cases, flanges of the wheels come into contact with the track. At this point, pressure is applied from the wheel flanges to the vehicle, the lateral pressure of the vehicle increases, and vibration and creaking sounds occur in the vehicle. As a result, there is a problem in that riding comfort of passengers is degraded and the wheel flanges wear out.

While taking such a problem into account, a low floor vehicle called an LRV (Light Rail Vehicle) as disclosed in Patent Literature 1, has been developed. In FIG. 13, an example of the configuration of this LRV is shown. A traveling direction of this LRV is indicated by an arrow A. In the explanation, it is assumed that the traveling direction is a vehicle front. Referring to FIG. 13, the LRV includes two front vehicles 102 and one intermediate vehicle 103 traveling on a track 101. As a vehicle composition, the one intermediate vehicle 103 is arranged between the two front vehicles 102.

Pin connectors 105 are arranged along an axis which extends in a vehicle vertical direction in connecting sections 104 between the front vehicles 102 and the intermediate vehicle 103. The front vehicles 102 are coupled to the intermediate vehicle 103 to be capable of turning around the pin connectors 105. Therefore, the front vehicles 102 and the intermediate vehicle 103 can curve around the pin connectors 105 so as to correspond to a curvature radius R of the curved track 101. Furthermore, in the connecting sections 104, any of dampers, springs, and the like (not shown) may be provided to suppress the turning of the front vehicles 102 and to secure safety during high speed traveling of the vehicle.

Trucks 107 are arranged under vehicle bodies 106 of the front vehicles 102. As shown in FIGS. 14 to 16, a pair of left and right wheels 108 is provided on each of a vehicle front side and a vehicle rear side of the truck 107. The pair of wheels 108 is configured to be pivotable independently from each other around the same axis 108*a* which extends in a vehicle width direction, and is coupled by a journal member 109. The journal member 109 is arranged on each of a vehicle front side and a vehicle rear side of each of truck frames 110. The truck frames are formed as frame members of the truck 107. A conical rubber 111 is provided as a shaft spring for the wheel 108 between the journal member 109 and the truck frame 110. Vibration transmitted from the wheel 108 to the truck frame 110, is suppressed by this conical rubber 111. Furthermore, the journal member 109 extends in a position close to the road surface between the pair of wheels 108. A floor surface (not shown) in the vehicle is arranged on the journal member 109. Therefore, the floor surface in the vehicle is configured to be close to the road surface.

Referring to FIG. 13 again, when the vehicle traveling in the traveling direction enters the curved track 101, force directed in a straight forward direction by inertia, acts on the vehicle bodies 106. Force directed in a tangential direction of the curved track, acts on the trucks 107. Therefore, force acting on the entire front vehicles 102 is unbalanced. At this point, the straight forward force by inertia also affects the trucks 107. The trucks 107 are less easily curved along the curved track 101. As a result, an attack angle $\alpha$, which is an angle in the traveling direction (indicated by an arrow C) of the wheel 108 with respect to the tangential direction (indicated by an arrow B) of the curved track, increases. It is likely that wheel flanges 108*b* (shown in FIGS. 14 to 16) of the wheels 108 on an outside rail side come into contact with the track. At the time of this contact, pressure is applied from the wheel flanges 108*b* to the vehicle, lateral pressure of the vehicle increases, and vibration and creaking sound occur in the vehicle. As a result, there is a problem in that riding comfortableness of passengers is degraded and the wheel flanges 108*b* wear out.

To absorb such unbalance of force, the trucks 107 are configured to be movable in the vehicle width direction with respect to the vehicle bodies 106. Specifically, as shown in FIGS. 14 to 16, traction rods 112 which transmit traction force of the truck 107 to the vehicle body 106, are arranged along a vehicle longitudinal direction. Ends 112*a* on the vehicle rear side of the traction rods 112 are attached to the truck 107 side via a spherical bush or a rubber vibration insulator (not shown). Ends 112*b* on the vehicle front side of the traction rods 112 are attached to the vehicle body 106 side via a spherical bush or a rubber vibration insulator (not shown).

CITATION LIST

Patent Documents

Patent Document 1: Japanese Patent Unexamined Publication No. 2008-132828

SUMMARY OF INVENTION

Technical Problem

However, in the vehicle of Patent Document 1, as shown in FIG. 13, the front vehicles 102 and the intermediate vehicle 103 are about to curve around the pin connectors 105 so as to correspond to the curvature radius R of the curved track 101 during the traveling of the vehicle on the curved track. However, in some cases, the front vehicles 102 do not sufficiently curve with respect to the intermediate vehicle 103 because of the influence of the dampers of the connecting sections 104. In some cases, the wheels 108 do not curve along the curved track while being affected by cant, slack, or the like of the curved track. In this case, it is likely that the traveling direction (indicated by the arrow 13) of the wheels 108 does not face the tangential direction (indicated by the arrow C) of the curved track 101 and the attack angle $\alpha$ increases. Therefore, the pressure is still applied from the wheel flanges 108*b* to the vehicle, the lateral pressure of the vehicle increases, and vibration and creaking sounds occur in the vehicle. As a result, there is a problem in that riding comfortableness of passengers is degraded and the wheel flanges 108*b* wear out.

As a further problem, a difference between forces acting on the vehicle bodies 106 and the trucks 107, is absorbed when the vehicle enters the curved track, and therefore, it is likely that, even if the trucks 107 move in the vehicle width direction with respect to the vehicle bodies 106, the straight forward force by inertia is large and imbalance of the force cannot be completely absorbed. In this case, the trucks 107 are still affected by the straight forward force by inertia. In some cases, the attack angle $\alpha$ increases. Accordingly, problems still result from the above occurring.

The present invention has been devised in view of such circumstances, and it is an object of the present invention to provide a low floor vehicle which can reduce, when the vehicle travels along a curved track, the lateral pressure on the vehicle, can prevent occurrence of vibration and creaking sounds of the vehicle, can improve riding comfort of passengers, and can reduce wear on wheel flanges.

Solution to Problems

In order to solve the problems, a low floor vehicle of the present invention is a low floor vehicle including: a truck provided under a vehicle body; a truck frame configured as a frame member of the truck; a pair of wheels configured to be pivotable independently from each other around the same axis which extends in a vehicle width direction, and configured to travel on a track; a journal member which couples the pair of wheels and is attached to the truck frame; and a truck frame lateral beam arranged along the vehicle width direction in a position closer to the center of a vehicle longitudinal direction of the truck frame than the journal member; wherein the pair of wheels, the journal member, and the truck frame lateral beam, are provided on each of a vehicle front side and a vehicle rear side of the truck; wherein the journal member is configured to be capable of turning with respect to the truck frame; wherein a pair of stub links on the left and right in the vehicle width direction which extends between the journal member and the truck frame lateral beam, are provided; wherein axes passing both ends of the pair of stub links are arranged to tilt so as to widen a space in the vehicle width direction between the axes with going from the truck frame lateral beam toward the journal member; and wherein both the ends of the stub links are respectively attached to the journal member and the truck frame lateral beam to so as be pivotable around axes which extend in a vehicle height direction.

Regarding the low floor vehicle of the present invention, the pair of stub links are provided on each of the vehicle front side and the vehicle rear side of the truck, and an intersection of the axes passing both the ends of the pair of stub links on the vehicle front side and the vehicle rear side, corresponds to a middle point of the truck frame, and the middle point of the truck frame is located at an intersection in which an axis of the vehicle extending in the vehicle longitudinal direction in the center in the vehicle width direction between the pair of wheels while in a linear track traveling state, and an axis extending in the vehicle width direction in the center in the vehicle longitudinal direction between the wheels on the vehicle front side and the vehicle rear side while in the linear track traveling state, intersect with each other.

Regarding the low floor vehicle of the present invention, stopper members provided in the truck frame are respectively arranged on the outer sides in the vehicle width direction of the pair of stub links to be capable of coming into contact with the stub links so as to regulate the pivotal movement of the stub links.

Furthermore, in order to solve the problems, a low floor vehicle of the present invention is a low floor vehicle including: a truck provided under a vehicle body; a truck frame configured as a frame member of the truck; a pair of wheels configured to be pivotable independently from each other around the same axis extending in a vehicle width direction and to travel on a track; a journal member which couples the pair of wheels and is attached to the truck frame; a truck frame lateral beam arranged along the vehicle width direction in a position closer to the center of a vehicle longitudinal direction of the truck frame than the journal member; wherein the pair of wheels, the journal member, and the truck frame lateral beam, are provided on each of a vehicle front side and a vehicle rear side of the truck; wherein the low floor vehicle includes: a first stub link including a pivotal arm section which extends between the journal member and the truck frame lateral beam on the vehicle front side and an interlocking lever section which extends along the vehicle longitudinal direction from the truck frame lateral beam toward the center of the truck frame; a second stub link extending between the journal member and the truck frame lateral beam on the vehicle front side; a third stub link including a pivotal arm section which extends between the journal member and the truck frame lateral beam on the vehicle rear side and an interlocking lever section which extends along the vehicle longitudinal direction from the truck frame lateral beam toward the center of the truck frame, and being arranged to be opposed to the first stub link; and a fourth stub link extending between the journal member and the truck frame lateral beam on the vehicle rear side, and being arranged to be opposed to the second stub link; wherein both ends of the pivotal arm sections of the first stub link and the third stub link and both ends of the second stub link and the fourth stub link are respectively attached to the journal member and the truck frame lateral beam so as to be pivotable around an axis extending in a vehicle height direction; wherein coupling pins are provided at one distal ends of the interlocking lever sections in the first stub link and the third stub link; wherein long holes extending in the vehicle longitudinal direction are provided at the other distal ends of the interlocking lever sections in the first stub link and the third stub link; and wherein the coupling pins and the long holes engage with each other, whereby the first stub link and the third stub link are configured to be pivotable in synchronization with each other.

Regarding the low floor vehicle of the present invention, a restoring rod or a horizontal damper arranged along the vehicle width direction and configured to be retractable in the vehicle width direction is provided in the truck, one end of the restoring rod or the horizontal damper is attached to one of the interlocking lever sections in the first stub link and the third stub link, and the other end of the restoring rod or the horizontal damper is attached to the truck frame.

Regarding the low floor vehicle of the present invention, an actuator arranged along the vehicle width direction and configured to be capable of reciprocatingly moving in the vehicle width direction is provided in the truck, one end of the actuator is attached to one of the interlocking lever sections in the first stub link and the third stub link, the other end of the actuator is attached to the truck frame, and the operation of the actuator is controlled according to a linear track traveling state of the vehicle and a curved track traveling state of the vehicle, whereby the journal member is configured to be capable of turning with respect to the truck frame.

Advantageous Effects of Invention

According to the present invention, effects explained below can be obtained. A low floor vehicle of the present invention is a low floor vehicle including: a truck provided under a vehicle body; a truck frame configured as a frame member of the truck; a pair of wheels configured to be pivotable independently from each other around the same axis which extends in a vehicle width direction, and configured to travel on a track; and a journal member which couples the pair of wheels and is attached to the truck frame; and a truck frame lateral beam arranged along the vehicle width direction in a position closer to the center of a vehicle longitudinal direction of the truck frame than the journal member; wherein the pair of wheels, the journal member, and the truck frame lateral beam are provided on each of a vehicle front side and a vehicle rear side of the truck; wherein the journal member is configured to be capable of turning with respect to the truck frame; wherein a pair of stub links on the left and right in the vehicle width direction which extends between the journal member and the truck frame lateral beam are provided; wherein axes passing both ends of the pair of stub links are arranged to tilt so as to widen a space in the vehicle width direction between the axes with going from the truck frame lateral beam toward the journal member; and wherein both the ends of the stub links are respectively attached to the journal member and the truck frame lateral beam so as to be pivotable around axes which extend in a vehicle height direction.

Accordingly, in the case in which the vehicle enters a curved track, if a wheel on an outside rail side of the pair of wheels comes into contact with the track and force is directed to the inner side in the vehicle width direction, is applied to the journal member, the journal member turns so as to follow the pivotal movement of the pair of stub links. At this point, the wheel on the outside rail side moves away from the center in the longitudinal direction of the truck, and the wheel on an inside rail side of the pair of wheels moves toward the center in the longitudinal direction of the truck. As a result, the wheel changes to a state along the curved track, and the vehicle can enter the curved track at a small attack angle. Contact pressure between the wheel on the outside rail side and the track is relaxed, lateral pressure on the vehicle is reduced, and occurrence of vibration and creaking sounds of the vehicle are prevented. Therefore, riding comfort of passengers is improved, and wear of a wheel flange is reduced.

Regarding the low floor vehicle of the present invention, the pair of stub links are provided on each of the vehicle front side and the vehicle rear side of the truck, an intersection of the axes passing both the ends of the pair of stub links on the vehicle front side and the vehicle rear side, corresponds to a middle point of the truck frame, and the middle point of the truck frame is located at an intersection in which an axis of the vehicle extending in the vehicle longitudinal direction in the center of the vehicle width direction between the pair of wheels while a linear track traveling state and an axis extending in the vehicle width direction in the center of the vehicle longitudinal direction between the wheels on the vehicle front side and the vehicle rear side while the linear track traveling state, intersect with each other. When the vehicle travels on a curved track, the middle point of the truck frame passes the center of a pair of tracks which is provided spaced apart from each other in the vehicle width direction. The wheels more surely run along the curved track, and can enter the curved track at a small attack angle. Therefore, the effects explained above can be more reliably obtained.

Regarding the low floor vehicle of the present invention, stopper members provided in the truck frame are respectively arranged on the outer sides in the vehicle width direction of the pair of stub links to be capable of coming into contact with the stub links so as to regulate the pivotal movement of the stub links. A pivoting amount of the stub links is restricted by the stopper members. As a result, a turning amount of the journal member and a movement amount of the wheels are restricted. Therefore, the effects explained above can be more reliably obtained, large movement of the wheels is prevented, and traveling stability of the vehicle is ensured.

Furthermore, a low floor vehicle of the present invention is a low floor vehicle including: a truck provided under a vehicle body; a truck frame configured as a frame member of the truck; a pair of wheels configured to be pivotable independently from each other around the same axis which extends in a vehicle width direction and configured to travel on a track; and a journal member which couples the pair of wheels and is attached to the truck frame; and a truck frame lateral beam arranged along the vehicle width direction in a position closer to the center of a vehicle longitudinal direction of the truck frame than the journal member; wherein the pair of wheels, the journal member, and the truck frame lateral beam, are provided on each of a vehicle front side and a vehicle rear side of the truck; wherein the low floor vehicle includes: a first stub link including a pivotal arm section which extends between the journal member and the truck frame lateral beam on the vehicle front side, and an interlocking lever section which extends along the vehicle longitudinal direction from the truck frame lateral beam toward the center of the truck frame; a second stub link extending between the journal member and the truck frame lateral beam on the vehicle front side; a third stub link including a pivotal arm section which extends between the journal member and the truck frame lateral beam on the vehicle rear side and an interlocking lever section which extends along the vehicle longitudinal direction from the truck frame lateral beam toward the center of the truck frame, and being arranged to be opposed to the first stub link; and a fourth stub link extending between the journal member and the truck frame lateral beam on the vehicle rear side and arranged to be opposed to the second stub link; wherein both ends of the pivotal arm sections of the first stub link and the third stub link and both ends of the second stub link and the fourth stub link, are respectively attached to the journal member and the truck frame lateral beam so as to be pivotable around an axis extending in a vehicle height direction; wherein coupling pins are provided at one distal end of the interlocking lever sections in the first stub link and the third stub link; wherein long holes extending in the vehicle longitudinal direction are provided at the other distal ends of the interlocking lever sections in the first stub link and the third stub link; and wherein the coupling pins and the long holes engage with each other, whereby the first stub link and the third stub link are configured to be pivotable in synchronization with each other.

Accordingly, in the case in which the vehicle enters a curved track, if a wheel on an outside rail side of the pair of wheels comes into contact with the track and force directed to the inner side in the vehicle width direction is applied to the journal member on the vehicle front side, the journal member turns so as to follow the pivotal movement of the first stub link and the second stub link. At this point, concerning the pair of wheels on the vehicle front side, the wheel on the outside rail side moves toward the vehicle front side, and the wheel on the inside rail side moves toward the vehicle rear side. As a result, the wheels change to a state in which the wheels more surely run along the curved track. The wheels can enter the curved track at a small attack angle.

When the journal member on the vehicle front side turns, the first stub link and the third stub link pivot in synchronization with each other, and the journal member on the vehicle rear side turns in association with the journal member on the vehicle front side. Therefore, even if the truck is affected by force acting on the vehicle, cant and slack in the curved track, and the like, the journal members on the vehicle front side and the vehicle rear side can surely turn in association with each other so as to correspond to the curved track without separately moving. As a result, the wheels which are provided in the journal members, change to a state in which the wheels more surely run along the curved track. The wheels can enter the curved track at a small attack angle. When the vehicle enters the curved track, contact pressure between the wheel on the outside rail side and the track is relaxed, lateral pressure on the vehicle is reduced, and occurrence of vibration and creaking sound of the vehicle is prevented. Therefore, riding comfortableness of passengers is improved, and wear of wheel flanges is reduced.

Regarding the low floor vehicle of the present invention, a restoring rod or a horizontal damper arranged along the vehicle width direction and configured to be retractable in the vehicle width direction is provided in the truck, one end of the restoring rod or the horizontal damper is attached to one of the interlocking lever sections in the first stub link and the third stub link, and the other end of the restoring rod or the horizontal damper is attached to the truck frame. The first stub link and the third stub link is allowed to return from a pivoted state during curved track traveling of the vehicle, to a state during linear track traveling of the vehicle by the restoring rod or the horizontal damper. Furthermore, swing of the first stub link and the third stub link during the linear track traveling, can be absorbed by the restoring rod or the horizontal damper. Occurrence of deflection of the journal members and the wheels on the basis of such swing can be prevented. Therefore, the effects explained above can be more reliably obtained, and traveling stability during the linear track traveling of the vehicle is improved.

Regarding the low floor vehicle of the present invention, an actuator arranged along the vehicle width direction and configured to be capable of reciprocatingly moving in the vehicle width direction is provided in the truck, one end of the actuator is attached to one of the interlocking lever sections in the first stub link and the third stub link, the other end of the actuator is attached to the truck frame, and the operation of the actuator is controlled according to a linear track traveling state of the vehicle and a curved track traveling state of the vehicle, whereby the journal member is configured to be capable of turning with respect to the truck frame. The pivotal movement of the first stub link and the third stub link can be controlled by the actuator. Therefore, it is possible to cause the wheels which are linked to the first stub link and the third stub link, to more surely enter the curved track at a small attack angle by, for example, the operation of the actuator corresponding to the curved track.

DESCRIPTION OF EMBODIMENTS

First Embodiment

Figure 1:
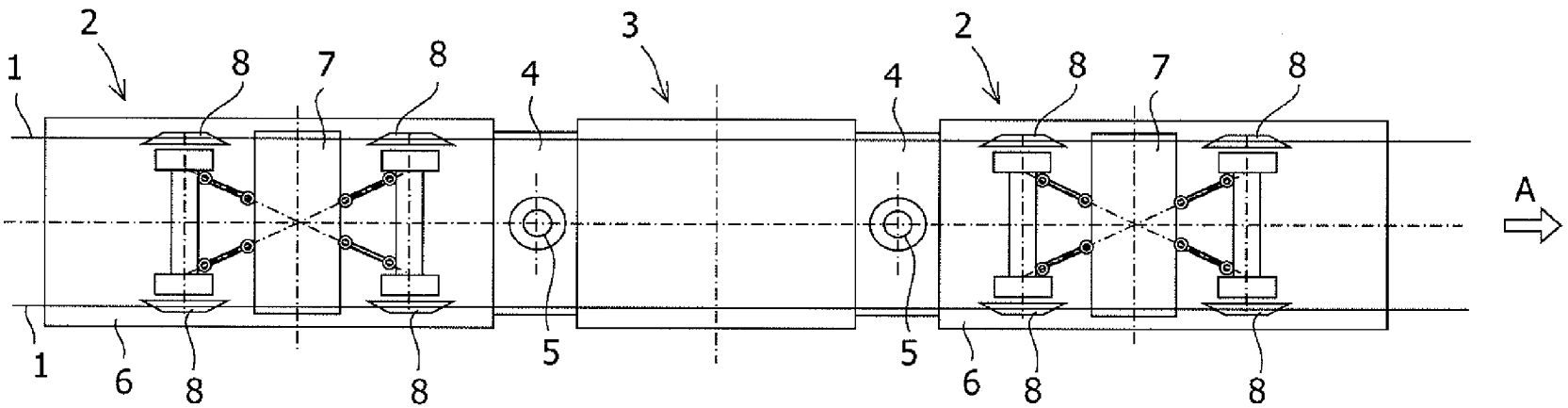
FIG. 1 is an explanatory diagram showing a low floor vehicle during linear track traveling in a first embodiment of the present invention.

A low floor vehicle (hereinafter referred to as a "vehicle") in a first embodiment of the present invention, is explained below. Regarding the first embodiment, the vehicle is explained using an LRV as shown in FIG. 1 as an example of the vehicle. In the explanation, it is assumed that a traveling direction of the vehicle is a vehicle front. FIG. 1 is a diagram showing the vehicle viewed from above. The traveling direction of the vehicle is indicated by the arrow A. The vehicle shown in FIG. 1 includes two front vehicles 2, and one intermediate vehicle 3 traveling on a track 1. As a vehicle composition, the one intermediate vehicle 3 is arranged between the two front vehicles 2. Connecting sections 4 are provided between the front vehicles 2 and the intermediate vehicle 3. Pin connectors 5 are provided in the connecting sections 4 along an axis extending in a vehicle vertical direction. The front vehicles 2 are coupled to the intermediate vehicle 3 so as to be capable of turning around the pin connectors 5. Trucks 7 are provided under vehicle bodies 6 of the front vehicles 2. Wheels 8 provided in the trucks 7 are configured to travel on the track 1.

Figure 2:
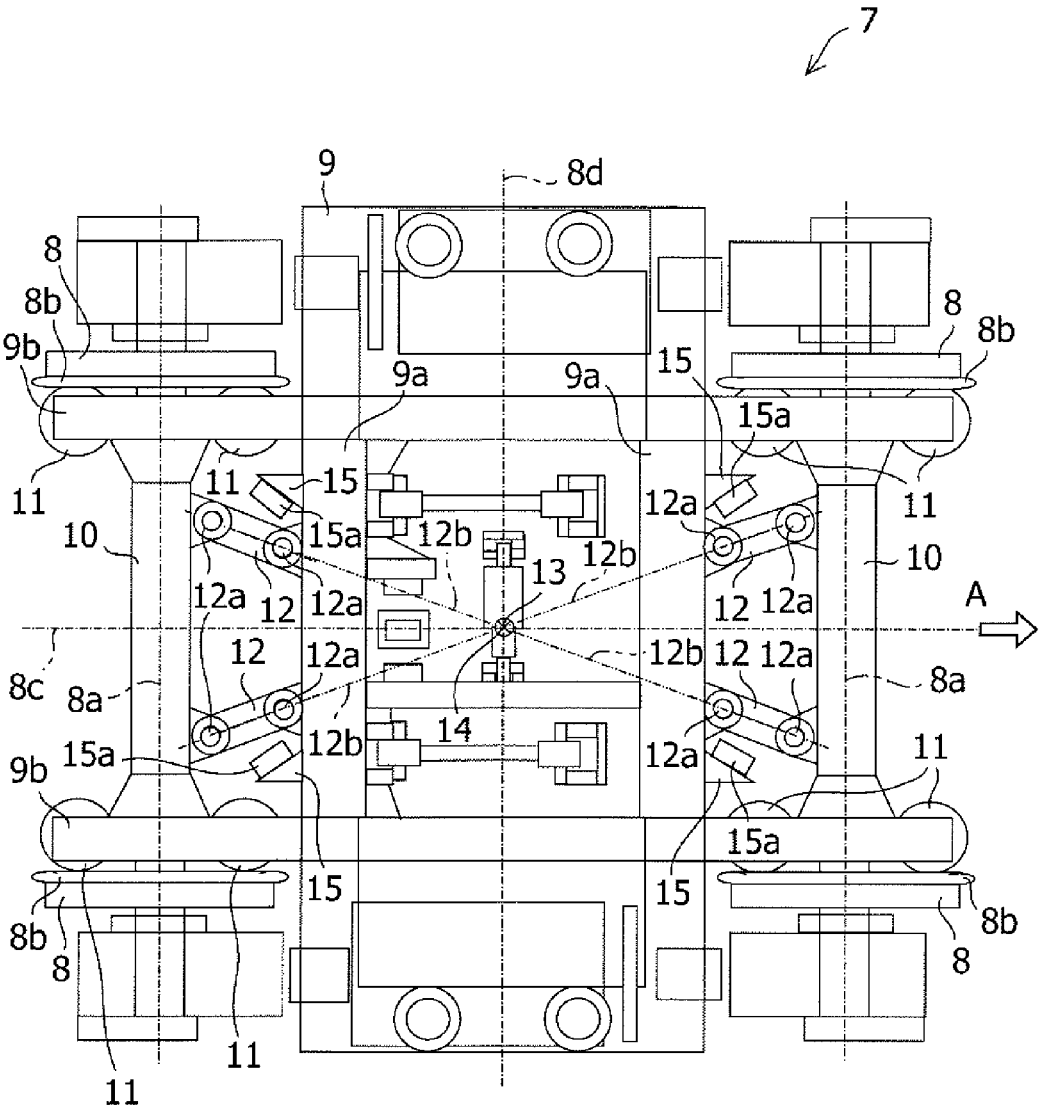
FIG. 2 is a plan view schematically showing a truck of the vehicle in the first embodiment of the present invention.

The structure of the truck 7 is explained with reference to the truck 7 in a state during linear traveling shown in FIG. 2. A traveling direction of the vehicle is indicated by the arrow A. In the truck 7, a truck frame 9 is provided as a frame member of the truck 7. The vehicle body 6 (shown in FIG. 1) is supported by this truck frame 9. Two truck frame lateral beams 9*a* extending in a vehicle width direction, are disposed in this truck frame 9 spaced apart from each other in a vehicle longitudinal direction. Furthermore, in the truck frame 9, two truck frame longitudinal beams 9*b* extending in the vehicle longitudinal direction, respectively cross the two truck frame lateral beams 9*a*, and are disposed spaced apart from each other in the vehicle width direction.

Journal members 10 are respectively provided at the front end and the rear end of the truck frame longitudinal beams 9*b*. Accordingly, the truck frame lateral beams 9*a* are located closer to the center of the vehicle longitudinal direction than the journal members 10. A pair of wheels 8 is attached at both ends in the vehicle width direction of each of the journal members 10 so as to be pivotable independently from each other about the same axis 8*a*. Wheel flanges 8*b* are provided at edges on the inner side of the vehicle width direction of the wheels 8. The journal member 10 is configured to extend near the road surface between both ends to which the wheels 8 are attached. Conical rubber members 11 are disposed, as shaft springs of the wheels 8, between the truck frame longitudinal beams 9*b* and the ends of the journal member 10. The ends of the journal members 10 are attached to the truck frame longitudinal beams 9*b* via the conical rubber members 11. The conical rubber members 11 are configured to absorb vibration which is applied from a vehicle vertical direction from the wheels 8, and are configured to enable the journal members 10 to turn with respect to the truck frame 9.

A pair of stub links 12 on the left and right in the vehicle width direction which extends between the truck frame lateral beam 9*a* and the journal member 10, are provided on each of the vehicle front side and the vehicle rear side of the truck 7. Both ends 12*a* of the stub links 12 are attached to the truck frame lateral beam 9*a* and the journal member 10 so as to be respectively pivotable around pivotal axes which extend in a vehicle height direction.

Axes 12*b* passing both the ends 12*a* of the pair of stub links 12, are arranged to widen a space between the axes 12*b* in the vehicle width direction going from the truck frame lateral beam 9*a* toward the journal member 10. The axes 12*b* of the stub links 12 cross each other only at one intersection 13. This intersection 13 coincides with a middle point 14 of the truck frame 9 located at an intersection in which an axis 8*c* of the vehicle extending in the vehicle longitudinal direction in the center of the vehicle width direction between the pair of wheels 8 while a linear track traveling state, and an axis 8*d* of the vehicle extending in the vehicle width direction in the center between the wheels 8 on the vehicle front side and the vehicle rear side while a linear track traveling state, intersect with each other.

Stopper members 15 are provided in the truck frame lateral beams 9*a*. The stopper members 15 are arranged spaced apart from edges on the outer sides in the vehicle width direction of the stub links 12 so as to regulate pivotal movement on the outer sides in the vehicle width direction of the stub links 12 to a fixed amount. In the stopper members 15, stopper rubber members 15*a* are provided in sections in contact with the stub links 12. Impact during contact of the stub links 12 and the stopper members 15 can be relieved.

Figure 3:
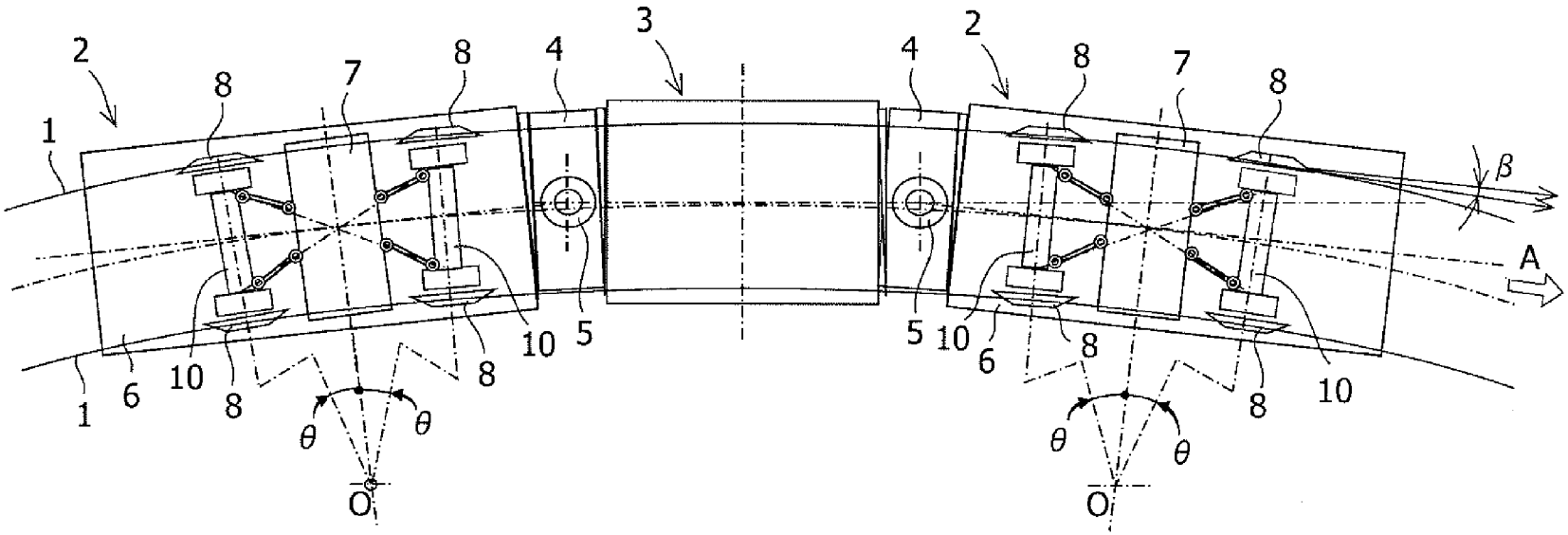
FIG. 3 is an explanatory view showing the low floor vehicle during curved track traveling in the first embodiment of the present invention.

Regarding such a vehicle in the first embodiment, an operation in traveling a curved track, is explained with reference to FIGS. 2 and 3. FIG. 3 is a diagram showing the vehicle viewed from above. A traveling direction of the vehicle is indicated by the arrow A.

When the front vehicle 2 on the vehicle front side enters the curved track, at first, the pair of wheels 8 on the vehicle front side, enter the curved track, and the wheel flange 8*b* of the wheel 8 on an outside rail side comes into contact with the track 1. At this point, force directed to the inner side in the vehicle width direction, is applied to the journal member 10 from the wheel flange 8*b*. Therefore, the journal member 10 turns so as to follow the pivotal movement of the pair of stub links 12, the wheel 8 on the outside rail side moves to the wheel front side, and the wheel 8 on an inside rail side moves to the vehicle rear side. Therefore, the pair of wheels 8 and the journal member 10 on the vehicle front side turn toward the vehicle front side by an angle θ with reference to a center O of a curvature radius R of the curved track.

In the front vehicle 2 on the vehicle front side, subsequently, the pair of wheels 8, on the vehicle rear side, enter the curved track, and the wheel flange 8*b* of the wheel 8 on the outside rail side comes into contact with the track 1. At this point, force directed to the inner side in the vehicle width direction from the vehicle flange 8*b*, is applied to the journal member 10. The wheel 8 on the outside track side turns so as to follow the pivotal movement of the pair of stub links 12, and moves to the vehicle rear side, and the wheel 8 on the inside rail side moves to the vehicle front side. Therefore, the pair of wheels 8, and the journal member 10 on the vehicle rear side, turn toward the vehicle rear side by the angle θ with reference to the center O of the curvature radius R of the curved track. As a result, the middle point 14 of the truck frame 9 passes the center between the pair of tracks 1. Such an operation is also performed in the front vehicle 2 on the vehicle rear side.

When large force is applied to the journal member 10 from the wheel flange 8*b*, the journal member 10 turns, and the wheel 8 is about to be moved by a degree equal to or greater than a fixed amount which destabilizes traveling of the vehicle, the stub links 12 attached to the journal member 10, come into contact with the stopper rubber members 15*a* of the stopper members 15.

As explained above, according to the vehicle in the first embodiment of the present invention, in the truck 7 of the front vehicle 2, the journal member 10 turns so as to follow the pivotal movement of the stub links 12. The pair of wheels 8 on the vehicle front side and the vehicle rear side, turn together with the journal member 10, and travels along the curved track at a small attack angle β. Contact pressure of the wheel 8 on the outside rail side and the track 1, is relaxed, lateral pressure of the vehicle is reduced, and occurrence of vibration and creaking sounds of the vehicle, are prevented. Therefore, riding comfort of passengers is improved and wear of wheel flanges 8*b* is reduced.

According to the vehicle in the first embodiment of the present invention, in the truck 7 in the liner track traveling state, the intersection 13 of the axes 12*b* of the stub links 12, coincides with the middle point 14 of the truck frame 9 explained above. The middle point 14 of the truck frame 9 passes the center of the pair of tracks 1. Therefore, the pair of wheels 8 surely run along the curved track in balance in the vehicle width direction and can enter the curved track at a smaller attack angle.

According to the vehicle in the first embodiment of the present invention, a pivoting amount of the stub links 12 is restricted by the stopper members 15. As a result, a turning amount of the journal member 10, and a movement amount of the wheel 8, are restricted. Therefore, the wheel 8 surely runs along the curved track, and can enter the curved track at a smaller attack angle, large movement of the wheel 8 is prevented, and traveling stability of the vehicle is ensured.

Second Embodiment

A vehicle in a second embodiment of the present invention is explained below. In the second embodiment, as in the first embodiment, the vehicle is explained using an LRV as an example of the vehicle. A basic configuration of the vehicle in the second embodiment is the same as the configuration of the vehicle in the first embodiment. Components that are the same as those in the first embodiment, are explained using reference numerals and signs, and names are the same as those in the first embodiment. Components different from those in the first embodiment are explained. In the explanation of the second embodiment, it is assumed that a traveling direction of the vehicle is a vehicle front.

Figure 4:
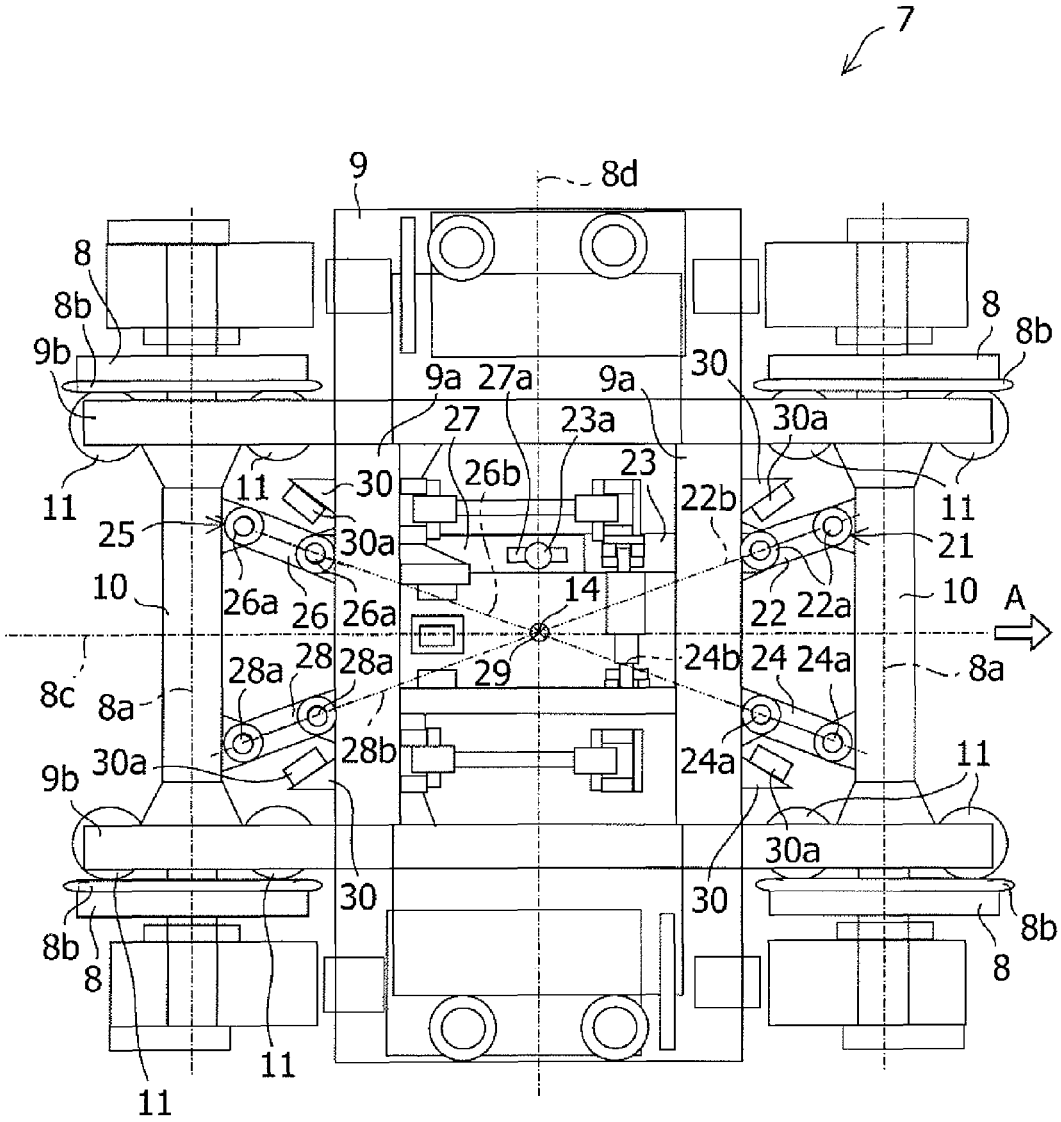
FIG. 4 is a plan view schematically showing a truck in a vehicle in a second embodiment of the present invention.

The structure of the truck 7 in the second embodiment is explained with reference to the truck 7 in a linear traveling time state shown in FIG. 4. In FIG. 4, a traveling direction of the vehicle is indicated by an arrow A. A first stub link 21 is disposed on the vehicle front side of the truck 7. A pivotal arm section 22 and an interlocking lever section 23 are provided in the first stub link 21. The pivotal arm section 22 extends between the truck frame lateral beam 9*a* and the journal member 10 on the vehicle front side. Both ends 22*a* of the pivotal arm section 22 are attached to the truck frame lateral beam 9*a* and the journal member 10 so as to be pivotable respectively around pivotal axes extending in the vehicle height direction.

The interlocking lever section 23 is formed to extend along the vehicle longitudinal direction from the truck frame lateral beam 9*a* on the vehicle front side toward the center of the truck frame 9. A coupling pin 23*a* is provided at the distal end of the interlocking lever section 23. This coupling pin 23*a* is arranged on the axis 8*d* of the vehicle which extends in the vehicle width direction in the center between the wheels 8 on the vehicle front side and the vehicle rear side.

A second stub link 24 is further provided on the vehicle front side of the truck 7. The second stub link 24 extends between the truck frame lateral beam 9*a* and the journal member 10 on the vehicle front side. Both ends 24*a* of the second stub link 24 are attached to the truck frame lateral beam 9*a* and the journal member 10 so as to be pivotable respectively around pivotal axes extending in the vehicle height direction.

A third stub link 25 is disposed on the vehicle rear side of the truck 7. The third stub link 25 is arranged to be opposed to the first stub link 21. A pivotal arm section 26 and an interlocking lever section 27 are provided in the third stub link 25. The pivotal arm section 26 extends between the truck frame lateral beam 9*a* and the journal member 10 on the vehicle rear side. Both ends 26*a* of the pivotal arm section 26 are attached to the truck frame lateral beam 9*a* and the journal member 10 so as to be pivotable respectively around pivotal axes extending in the vehicle height direction.

The interlocking lever section 27 is formed to extend along the vehicle longitudinal direction from the truck frame lateral beam 9*a* on the vehicle front side toward the center of the truck frame 9. A long hole 27*a* is drilled at the distal end of the interlocking lever section 27. This long hole 27*a* is formed to extend in the vehicle longitudinal direction so as to correspond to the coupling pin 23*a* of the first stub link 21. The coupling pin 23*a* of the first stub line 21 engages with the long hole 27*a* of the third stub link 25. In the linear traveling state, the coupling pin 23*a* is located in the center in the vehicle longitudinal direction of the long hole 27*a*.

A fourth stub link 28 is further disposed on the vehicle rear side of the truck 7. The fourth stub link 28 extends between the truck frame lateral beam 9*a* and the journal member 10 on the vehicle front side. Both ends 28*a* of the fourth stub link 28 are attached to the truck frame lateral beam 9*a* and the journal member 10 so as to be pivotable respectively around pivotal axes extending in the vehicle height direction.

An axis 22*b* passing both the ends 22*a* of the pivotal arm section 22 of the first stub link 21, and an axis 24*b* passing both the ends 24*a* of the second stub link 24, are arranged to tilt so as to widen a space between the axes 22*b* and 24*b* in the vehicle width direction with going from the truck frame lateral beam 9*a* toward the journal member 10. An axis 26*b* passing both the ends 26*a* of the pivotal arm section 26 of the third stub link 25, and an axis 28*b* passing both the ends 28*a* of the fourth stub link 28, are arranged to tilt so as to widen a space between the axes 26*b* and 28*b* in the vehicle width direction with going from the truck frame lateral beam 9*a* toward the journal member 10. These axes 22*b*, 24*b*, 26*b*, and 28*b* cross one another only at one intersection 29. This intersection 29 coincides with the middle point 14 of the truck frame 9 in the same manner as the first embodiment.

Plural stopper members 30 are provided in the truck frame lateral beams 9*a*. These stopper members 30 are respectively arranged spaced apart from edges on the outer sides, in the vehicle width direction, of the pivotal arm section 22 in the first stub link 21, of the second stub link 24, of the pivotal arm section 26 in the third stub link 25, and of the fourth stub link 28. The pivotal movement on the outer sides in the vehicle width direction of the first to fourth stub links 21, 24, 25, and 28, is regulated to a fixed amount by such stopper members 30. Stopper rubber members 30*a* are provided in the stopper members 30. Impact during contact of the first to fourth stub links 21, 24, 25, and 28 and the stopper members 30, can be relaxed by the stopper rubber members 30*a*.

Regarding such a vehicle in the second embodiment, an operation in traveling on the curved track is explained with reference to FIGS. 3 and 4. FIG. 4 is a diagram showing the vehicle viewed from above. A traveling direction of the vehicle is indicated by the arrow A.

When the front vehicle 2 on the vehicle front side enters the curved track, at first, the pair of wheels 8 on the vehicle front side, enter the curved track, and the wheel flange 8*b* of the wheel 8 on the outside rail side, comes into contact with the track 1. At this point, force directed to the inner side in the vehicle width direction is applied to the journal member 10 from the wheel flange 8*b*. Therefore, the journal member 10 turns so as to follow the pivotal movement of the first stub link 21 and the second stub link 24, the wheel 8 on the outside rail side moves to the vehicle front side, and the wheel 8 on the inside rail side moves to the vehicle rear side.

At this point, the first stub link 21 and the third stub link 25, pivot in synchronization with each other according to engagement of the coupling pin 23*a* of the first stub link 21 and the long hole 27*a* of the third stub link 25. Therefore, the journal member 10 on the vehicle rear side, turns in the opposite direction of the turning direction of the journal member 10 on the vehicle front side. In the journal member 10 on the vehicle rear side, the wheel 8 on the outside rail side moves to the vehicle rear side, and the wheel 8 on the inside rail side moves to the vehicle front side. At this point, the pair of wheels 8 and the journal member 10 on the vehicle front side, turn toward the vehicle front side at the angle θ with reference to the center O of the curvature radius R of the curved track, and the pair of wheels 8 and the journal member 10 on the vehicle rear side turn toward the vehicle rear side by the angle θ with reference to the center O of the curvature radius R of the curved track. As a result, the middle point 14 of the truck frame 9 passes the center between the pair of tracks 1.

When large force is applied to the journal member 10 from the wheel flange 8*b*, the journal member 10 turns, and the wheel 8 is about to move by a degree equal to or greater than a fixed amount that destabilizes traveling of the vehicle. The first to fourth stub links 21, 24, 25, and 28 attached to the journal member 10, come into contact with the stopper rubber members 30*a* of the stopper members 30.

As explained above, according to the vehicle in the second embodiment of the present invention, effects the same as those in the first embodiment are obtained. In addition, the first stub link 21 and the third stub link 25, pivot in synchronization with each other. Accordingly, the journal member 10 on the vehicle rear side turns in association with the journal member 10 on the vehicle front side. Therefore, even if the truck 7 is affected by force acting on the vehicle body 6 and cant, slack, or the like, in the curved track, the journal members 10 on the vehicle front side and the vehicle rear side, can surely turn in association with each other so as to correspond to the curved track without separately moving. As a result, the wheels 8 provided in the journal member 10, change to a state in which the wheels 8 more surely run along the curved track. The wheels 8 can enter the curved track at a small attack angle.

Third Embodiment

A vehicle in a third embodiment of the present invention is explained below. In the third embodiment, as in the first and second embodiments, the vehicle is explained using a LRV as an example of the vehicle. A basic configuration of the vehicle in the third embodiment is the same as the configuration of the vehicle in the second embodiment. Components the same as those in the second embodiment, are explained using reference numerals and signs and the names are the same as those in the second embodiment. Components different from those in the second embodiment are explained. In the explanation of the third embodiment, it is assumed that a traveling direction of the vehicle is to a vehicle front.

Figure 5:
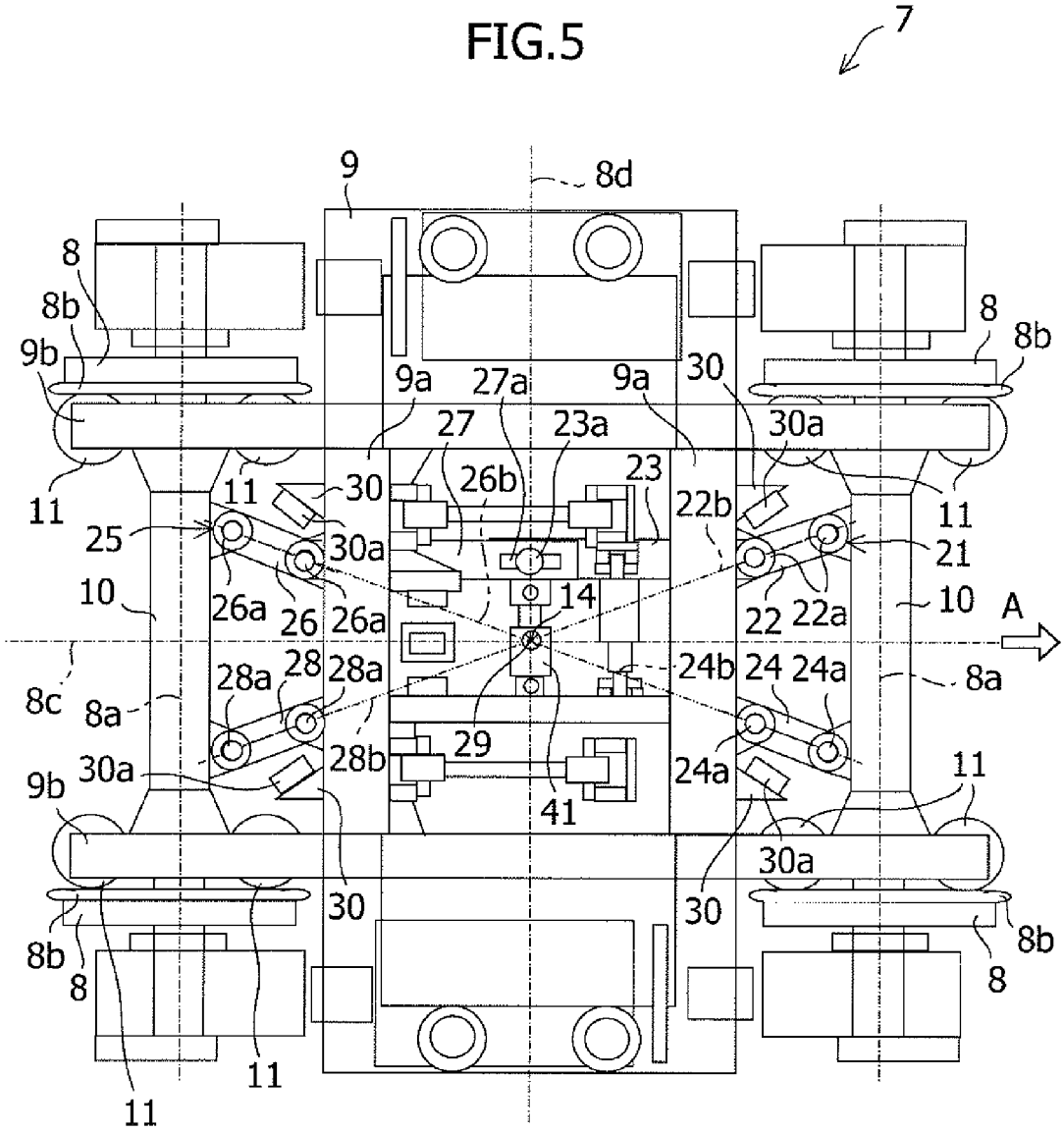
FIG. 5 is a plan view schematically showing a truck in a vehicle in a third embodiment of the present invention.

The structure of the truck 7 in the third embodiment is explained with reference to the truck 7 in the linear traveling state shown in FIG. 5. A traveling direction of the vehicle is indicated by the arrow A. As an example, a restoring rod 41 is provided in the truck 7. As another example, a horizontal damper may be provided instead of the restoring rod 41. The restoring rod 41 is arranged along the vehicle width direction, and is configured to be retractable in the vehicle width direction. One end of the restoring rod 41 is attached to one of the interlocking lever sections 23 and 27 of the first stub link 21 and the third stub link 25, so as to be pivotable around an axis extending in the vehicle vertical direction. The other end of the restoring rod 41 is attached to a beam extending between the two truck frame lateral beams 9*a* of the truck frame 9, so as to be pivotable around an axis extending in the vehicle vertical direction.

Figure 6:
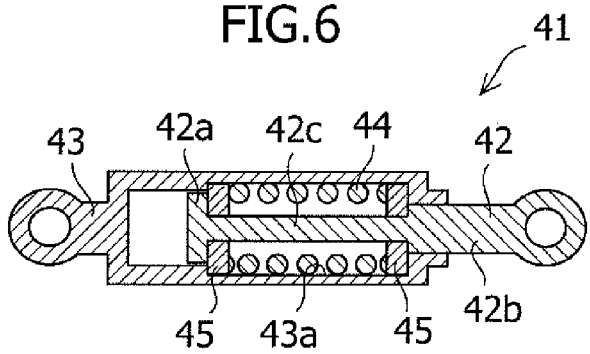
FIG. 6 is a longitudinal sectional view showing a schematic structure of a restoring rod in the vehicle in the third embodiment of the present invention.

An example of the structure of the restoring rod 41 is explained with reference to FIG. 6. A piston rod 42 extending along a longitudinal direction of the restoring rod 41, and a cylindrical cylinder 43 extending along the longitudinal direction, are provided in the restoring rod 41. A head section 42*a* is provided at the distal end of the piston rod 42. A cap section 42*b* is provided at the proximal end of the piston rod 42. A rod section 42*c* extends between the head section 42*a* and the cap section 42*b*. A coil spring 44 is provided in an internal space of the cylinder 43. A recessed section 43*a* is provided on an inner circumferential wall of the internal space of the cylinder 43 such that the coil spring 44 can be arranged in a compressed state. The coil spring 44 is arranged in this recessed section 43*a*. Furthermore, guide washers 45 are respectively disposed at both ends in the vehicle width direction of the coil spring 44.

The guide washers 45 are pressed against both ends in the vehicle width direction of the recessed section 43*a* by pressure from the coil spring 44 in the compressed state. The rod section 42*c* of the piston rod 42 is arranged to pass through the coil spring 44 and the guide washers 45. One of the head section 42*a* and the cap section 42*b* is configured to compress the coil spring 44 while engaging with the guide washer 45 during movement in the longitudinal direction of the piston rod 42.

As explained above, according to the vehicle in the third embodiment of the present invention, effects the same as those in the second embodiment are obtained. In addition, the first stub link 21 and the third stub link 25 can be returned from a state in which the stub links are pivoted during the curved track traveling of the vehicle to a state during the linear track traveling of the vehicle by the restoring rod 41. Furthermore, vibration of the first stub link 21 and the third stub link 25 during the linear track traveling, can be absorbed by the restoring rod 41. Occurrence of vibration of the journal members 10 and the wheels 8 on the basis of such swing, can be prevented. Therefore, it is possible to improve traveling stability during the linear track traveling of the vehicle.

Fourth Embodiment

A vehicle in the fourth embodiment of the present invention is explained below. In the fourth embodiment, as in the first to third embodiments, the vehicle is explained using a LRV as an example of the vehicle. A basic configuration of the vehicle in the fourth embodiment is the same as the configuration of the vehicle in the third embodiment. Components that are the same as those in the third embodiment are explained using reference numerals and signs and the names are the same as those in the third embodiment. Components different from those in the third embodiment are explained. In the explanation of the fourth embodiment, it is assumed that a traveling direction of the vehicle is a vehicle front.

Figure 7:
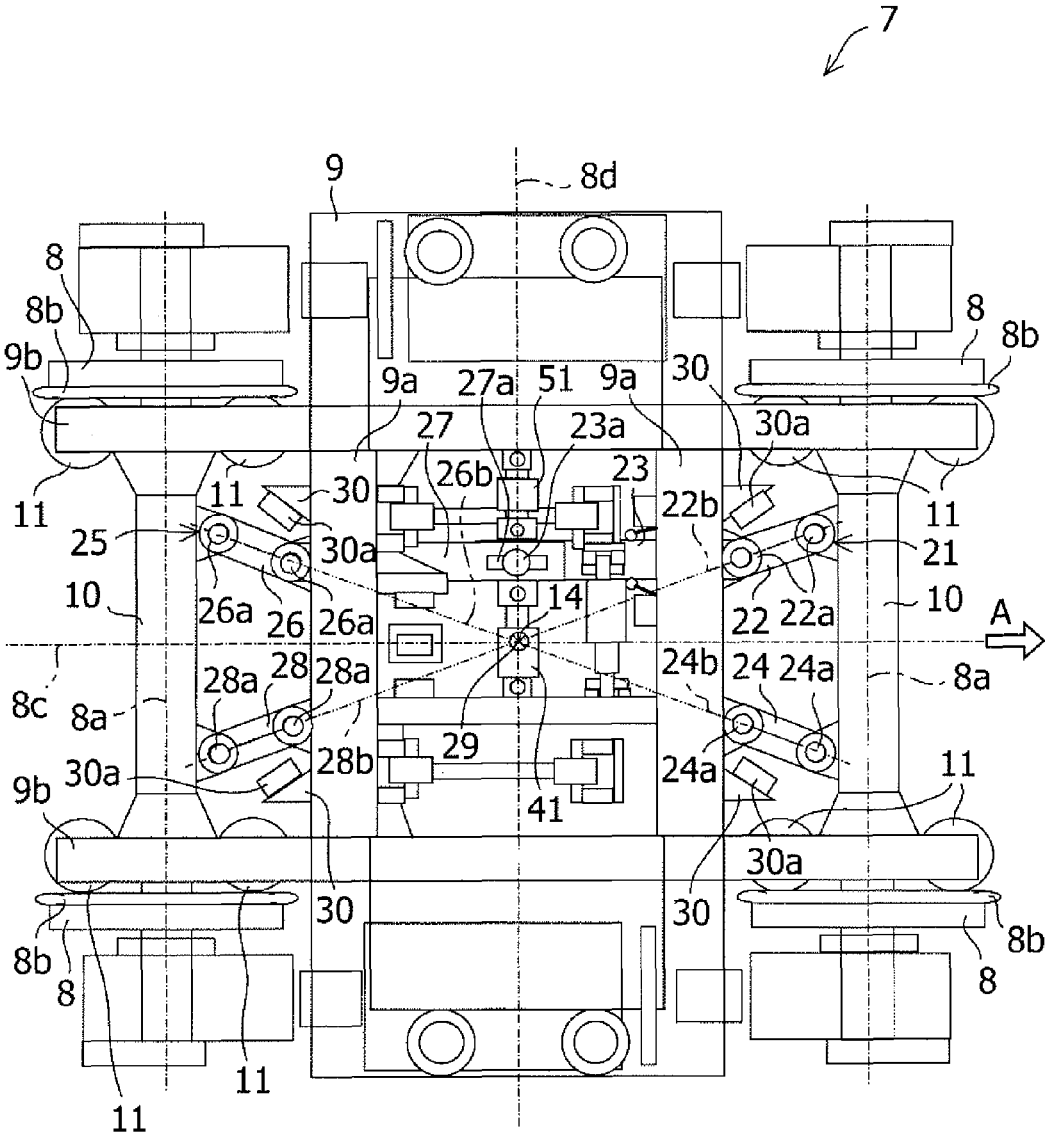
FIG. 7 is a plan view schematically showing a truck in a vehicle in a fourth embodiment of the present invention.

The structure of the truck 7 in the fourth embodiment is explained with reference to the truck 7 in a linear traveling time state shown in FIG. 7. A traveling direction of the vehicle is indicated by the arrow A. An actuator 51 is provided in the truck 7. The actuator 51 is arranged along the vehicle width direction and is configured to be capable of reciprocatingly moving in the vehicle width direction. One end of this actuator 51 is attached to one of the interlocking lever sections 23 and 27 in the first stub link 21 and the third stub link 25, so as to be pivotable around an axis extending in the vehicle vertical direction. The other end of the actuator 51 is attached to a truck frame longitudinal beam 9*b*, so as to be pivotable around an axis extending in the vehicle vertical direction. In FIG. 7, the actuator 51 is in a neutral state.

Figure 8:
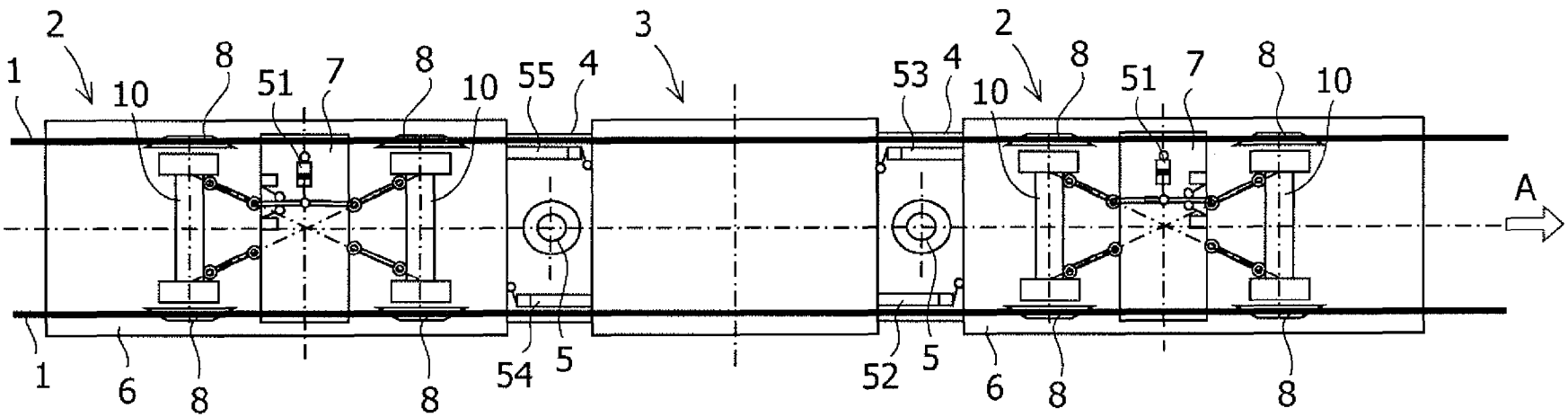
FIG. 8 is an explanatory diagram showing a low floor vehicle during linear track traveling of the vehicle in the fourth embodiment of the present invention.

In order to control the operation of the actuator 51, as shown in FIG. 8, plural switches are provided in the vehicle. FIG. 8 is a diagram showing the vehicle viewed from above. The traveling direction of the vehicle is indicated by the arrow A. In the fourth embodiment, as an example, four switches 52, 53, 54, and 55 are used.

The first switch 52 corresponding to the track 1 on the traveling direction right side, and the second switch 53 corresponding to the track 1 on the traveling direction left side, are set in the connecting section 4 between the front vehicle 2 on the vehicle front side and the intermediate vehicle 3. The actuator 51 in the front vehicle 2 on the vehicle front side is configured to be controlled by the first switch 52 and the second switch 53. The third switch 54, corresponding to the track 1 on the traveling direction right side, and the fourth switch 55, corresponding to the track 1 on the traveling direction left side, are set. The actuator 51 in the front vehicle 2 on the vehicle rear side is configured to be controlled by the third switch 54 and the fourth switch 55.

Switching of the first to fourth switches 52, 53, 54, and 55 during curved track passage of the vehicle and an operation state of the actuator 51 on the basis of this switching, are explained. In the fourth embodiment of the present invention, as an example, in the first to fourth switches 52, 53, 54, and 55, a switch located on the inside rail side of the curved track is configured to be turned on, when the curvature radius R of the curved track on which the vehicle passes, is equal to or less than R100.

When the vehicle passes on a linear track as shown in FIG. 8, all the first to fourth switches 52, 53, 54, and 55 are off. At this point, the actuator 51 is in the neutral state without operating.

Figure 9:
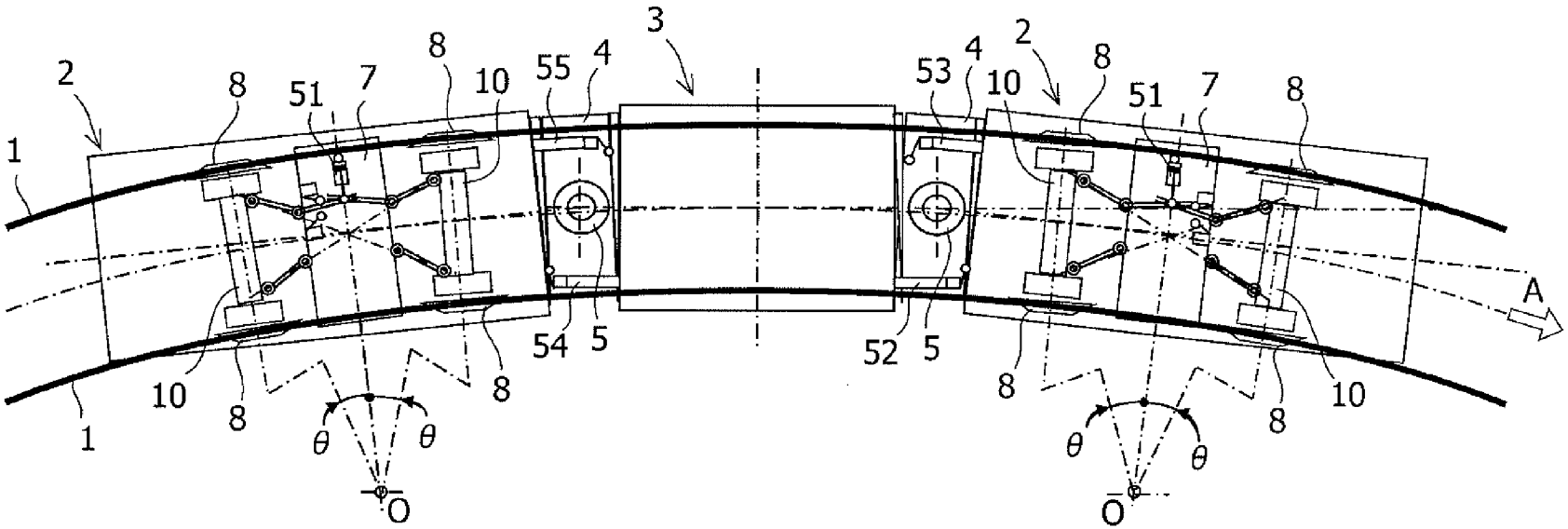
FIG. 9 is an explanatory diagram showing the low floor vehicle during right-curved track traveling in the fourth embodiment of the present invention.

The switching of the first to fourth switches 52, 53, 54 and 55, and the operation state of the actuator 51, in the case in which the vehicle passes on a right-curved track curving to the traveling direction right side, are explained using FIG. 9. FIG. 9 is a diagram showing the vehicle viewed from above. The traveling direction of the vehicle is indicated by the arrow A. In FIG. 9, the first switch 52 and the third switch 54 on the inside rail side of the right-curved track, are on, and the second switch 53 and the fourth switch 55 on the outside rail side of the right-curved track, are off. At this point, in the front vehicles 2 on the vehicle front side and the vehicle rear side, the actuators 51 respectively perform a contraction operation. Therefore, the interlocking lever sections 23 and 27 of the first stub link 21 and the third stub link 25, pivot toward the traveling direction left side. The pivotal arm sections 22 and 26 of the first stub link 21 and the third stub link 25 pivot toward the traveling direction right side.

Accordingly, the journal member 10 on the vehicle front side turns to the right so as to move the wheel 8 on the traveling direction right side to the vehicle rear side and move the wheel 8 on the traveling direction left side to the vehicle front side. On the other hand, the journal member 10 on the vehicle rear side turns to the left, so as to move the wheel 8 on the traveling direction right side to the vehicle front side and move the wheel 8 on the traveling direction left side to the vehicle rear side. At this point, the pair of wheels 8 and the journal member 10 on the vehicle front side, turn toward the vehicle front side by the angle θ with reference to the center O of the curvature radius R of the right-curved track. The pair of wheels 8 and the journal member 10 on the vehicle rear side, turn toward the vehicle rear side by the angle θ with reference to the center O of the curvature radius R of the right-curved track.

Figure 10:
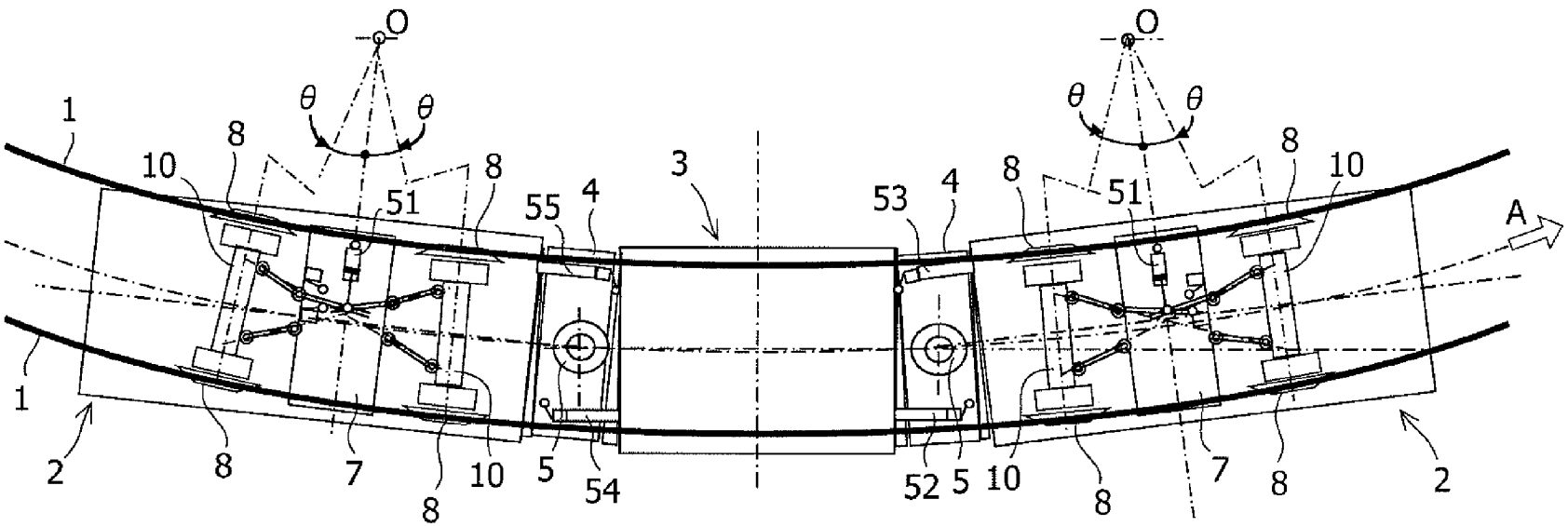
FIG. 10 is an explanatory diagram showing the low floor vehicle during left-curved track traveling in the fourth embodiment of the present invention.

The switching of the first to fourth switches 52, 53, 54 and 55, and the operation state of the actuator 51, in the case in which the vehicle passes on a right-curved track curving to the traveling direction left side, are explained using FIG. 10. FIG. 10 is a diagram showing the vehicle viewed from above. The traveling direction of the vehicle is indicated by the arrow A. In FIG. 10, the second switch 53 and the fourth switch 55 on the inside rail side of the left-curved track, are on, and the first switch 52 and the third switch 54 on the outside rail side of the left-curved track, are off. At this point, in the front vehicles 2 on the vehicle front side and the vehicle rear side, the actuators 51 respectively perform an expansion operation. Therefore, the interlocking lever sections 23 and 27 of the first stub link 21 and the third stub link 25 pivot toward the traveling direction right side. The pivotal arm sections 22 and 26 of the first stub link 21 and the third stub link 25 pivot toward the traveling direction left side.

Accordingly, the journal member 10 on the vehicle front side turns to the left, so as to move the wheel 8 on the traveling direction right side to the vehicle front side and move the wheel 8 on the traveling direction left side to the vehicle rear side. On the other hand, the journal member 10 on the vehicle rear side turns to the right, so as to move the wheel 8 on the traveling direction right side to the vehicle rear side and move the wheel 8 on the traveling direction left side to the vehicle front side. At this point, the pair of wheels 8 and the journal member 10 on the vehicle front side, turn toward the vehicle front side by the angle θ with reference to the center O of the curvature radius R of the left-curved track. The pair of wheels 8, and the journal member 10 on the vehicle rear side, turn toward the vehicle rear side by the angle θ with reference to the center O of the curvature radius R of the left-curved track.

A control flow of the actuator 51 on the basis of the switching of the first to fourth switches 52, 53, 54 and 55 during the curved track passage of the vehicle, is explained with reference to FIGS. 11 and 12.

The control flow in the case in which the vehicle passes on the right-curved track curving to the traveling direction right side, is explained.

Figure 11:
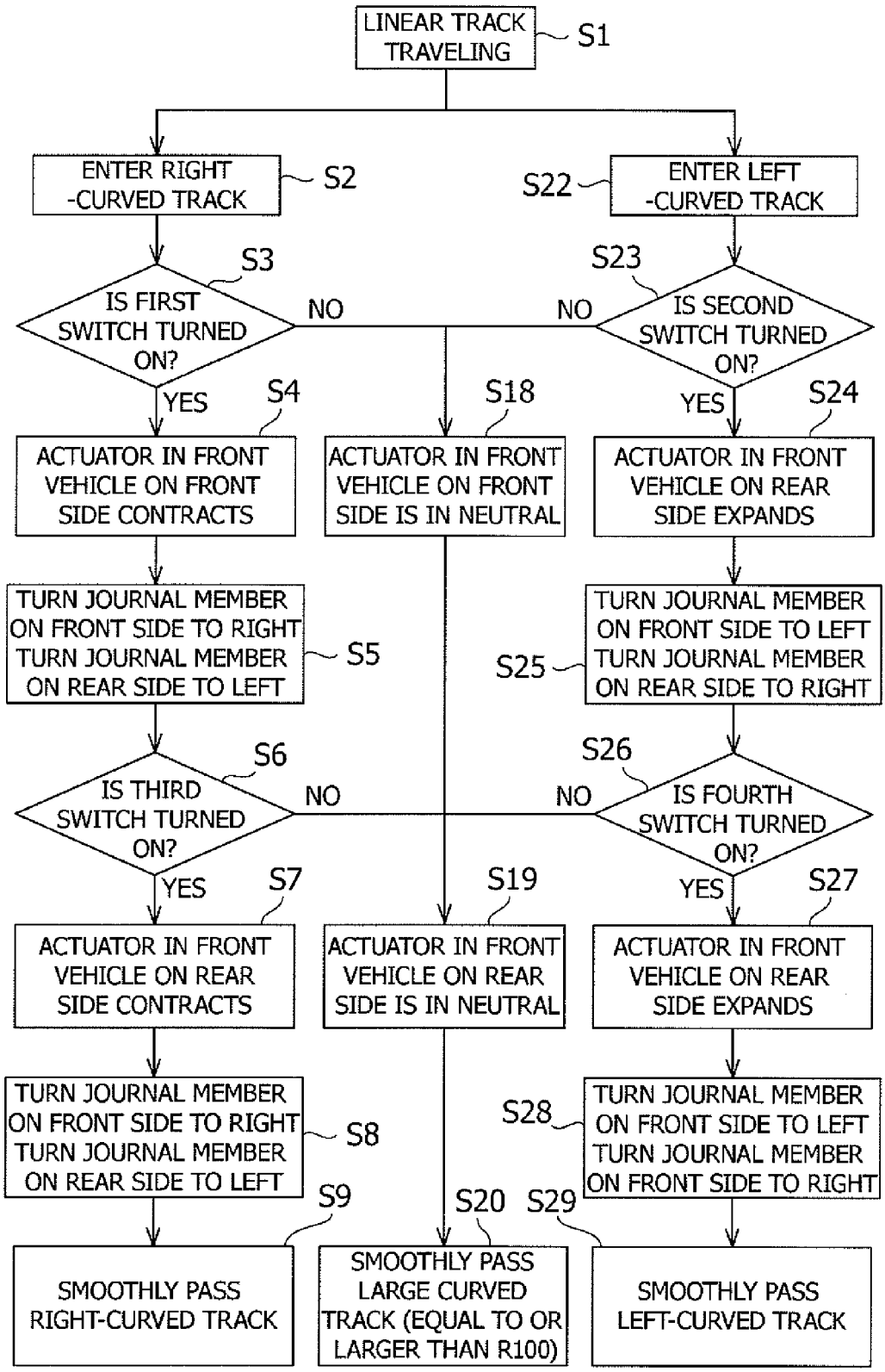
FIG. 11 is a control flow of an actuator of the vehicle that passes on a curved track in the fourth embodiment of the present invention.

Referring to FIG. 11, from a state in which the front vehicle 2 on the vehicle front side is traveling on the linear track (S1), when the vehicle enters the right-curved track (S2), if the curvature radius R of the curved track is equal to or less than R100, the first switch 52 is turned on, and on the other hand, if the curvature radius R of the curved track is equal to or greater than R100, the first switch 52 is kept off (S3). If the curvature radius R of the curved track is equal to or less than R100 and the first switch 52 is turned on (S3), the actuator 51 performs the contraction operation in the front vehicle 2 on the vehicle front side (S4), the journal member 10 on the vehicle front side turns to the right, and the journal member 10 on the vehicle rear side turns to the left (S5).

Furthermore, in the case in which the front vehicle 2 on the vehicle rear side enters the right-curved track, if the curvature radius R of the curved track is equal to or less than R100, the third switch 54 is turned on, and on the other hand, if the curvature radius R of the curved track is equal to or greater than R100, the third switch 54 is kept on (S6). If the curvature radius R of the curved track is equal to or less than R100 and the third switch 54 is turned on (S6), the actuator 51 performs the contraction operation in the front vehicle 2 on the vehicle rear side (S7), the journal member 10 on the vehicle front side turns to the right, and the journal member 10 on the vehicle rear side turns to the left (S8). As a result, the vehicle smoothly passes on the right-curved track which has the curvature radius equal to or less than R100 (S9).

Figure 12:
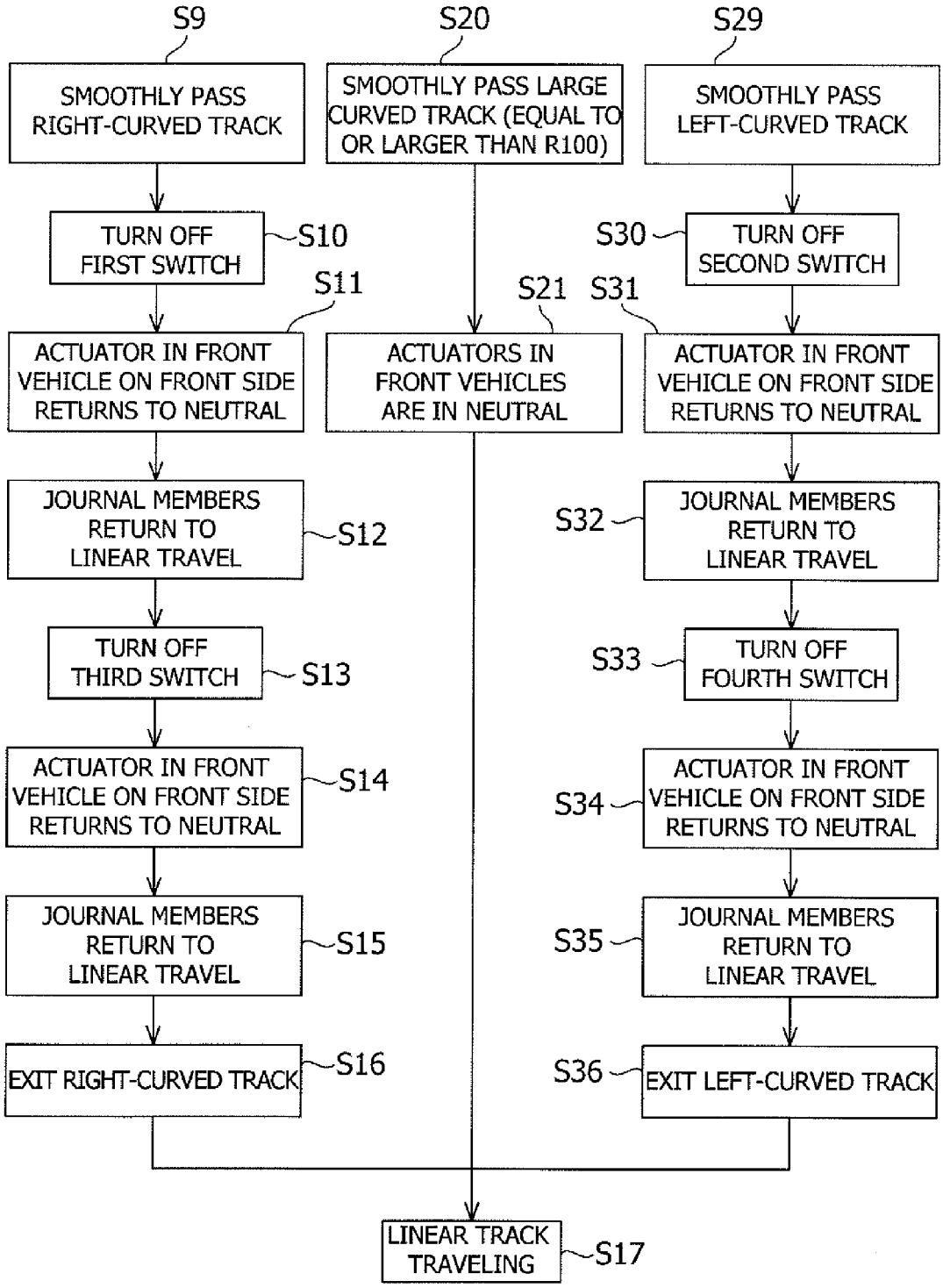
FIG. 12 is a control flow of the actuator of the vehicle that exits the curved track in the fourth embodiment of the present invention.
Figure 13:
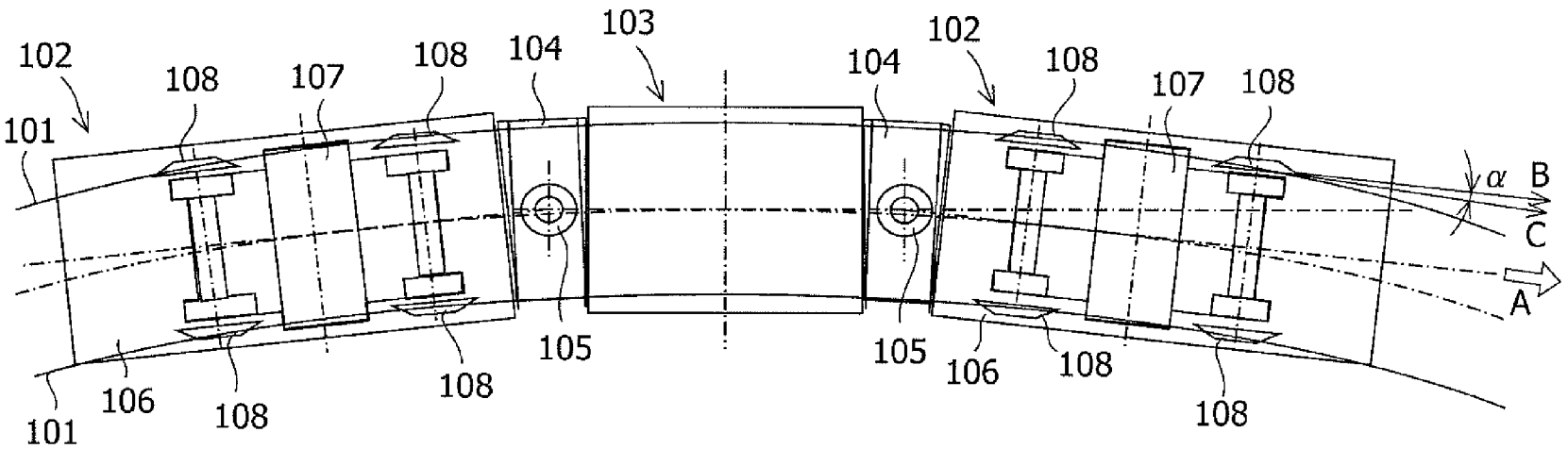
FIG. 13 is an explanatory diagram showing a conventional low floor vehicle during curved track traveling.
Figure 14:
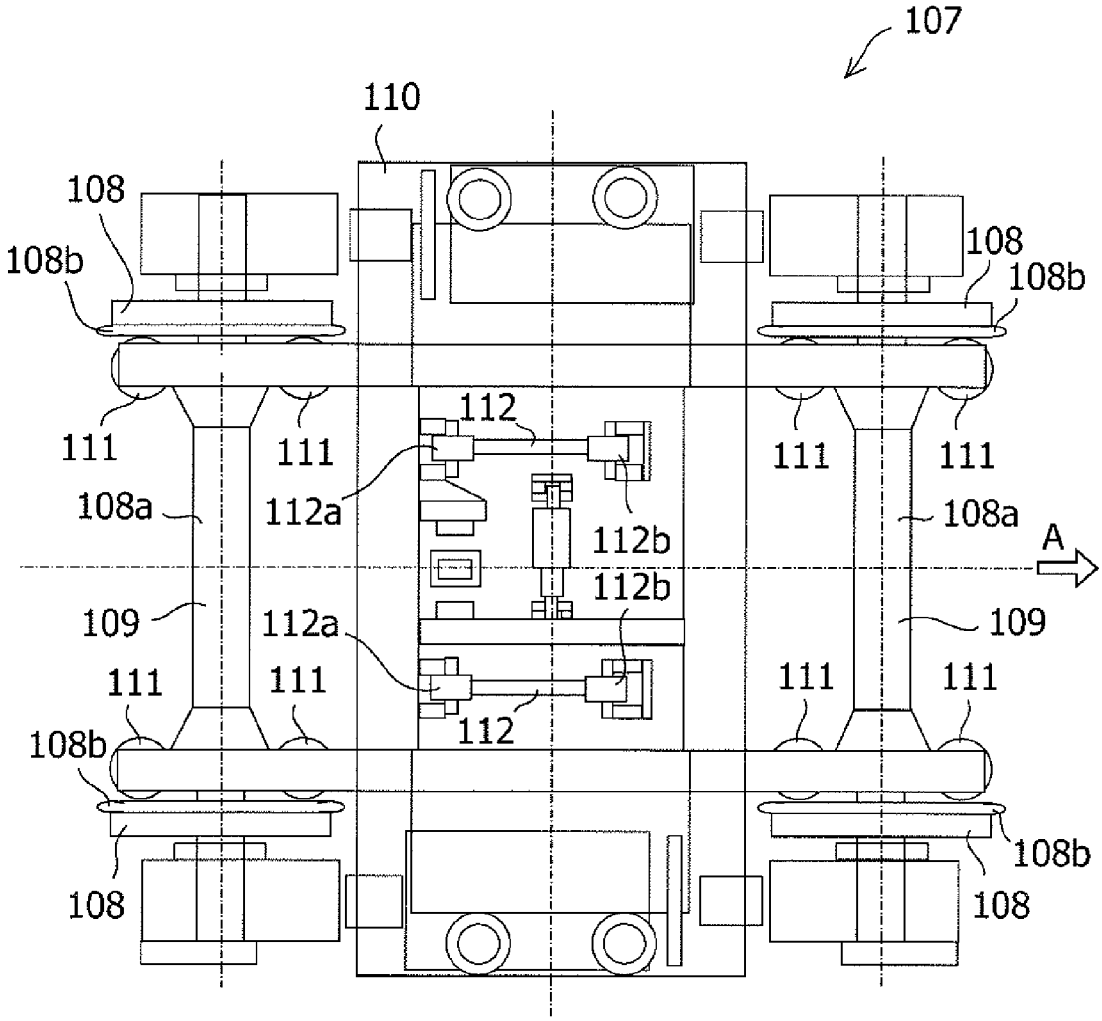
FIG. 14 is a plan view schematically showing a truck of the conventional low floor vehicle.
Figure 15:
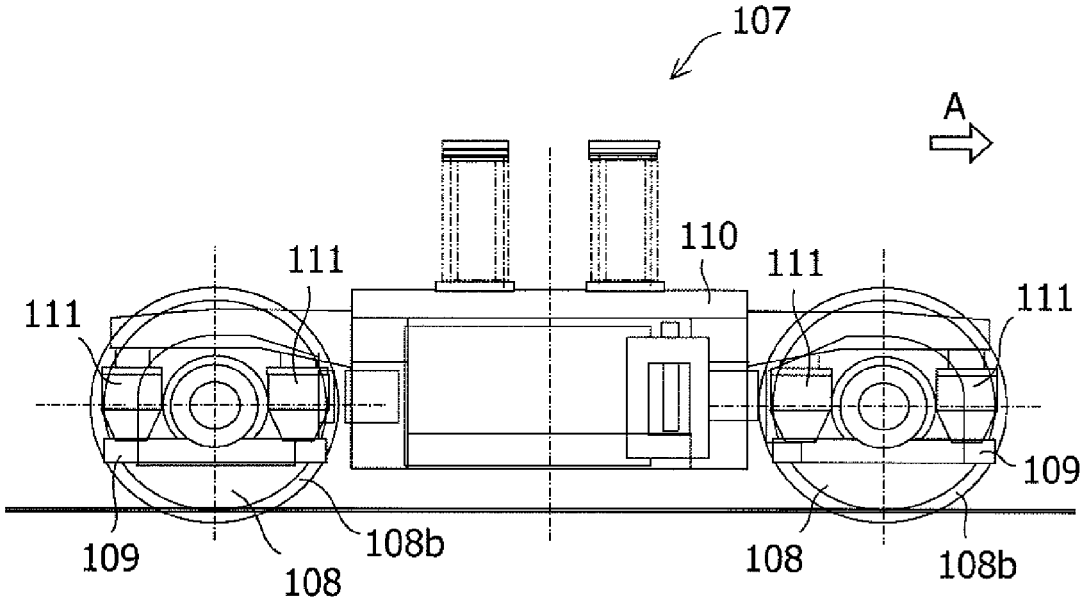
FIG. 15 is a side view schematically showing the truck of the conventional low floor vehicle.
Figure 16:
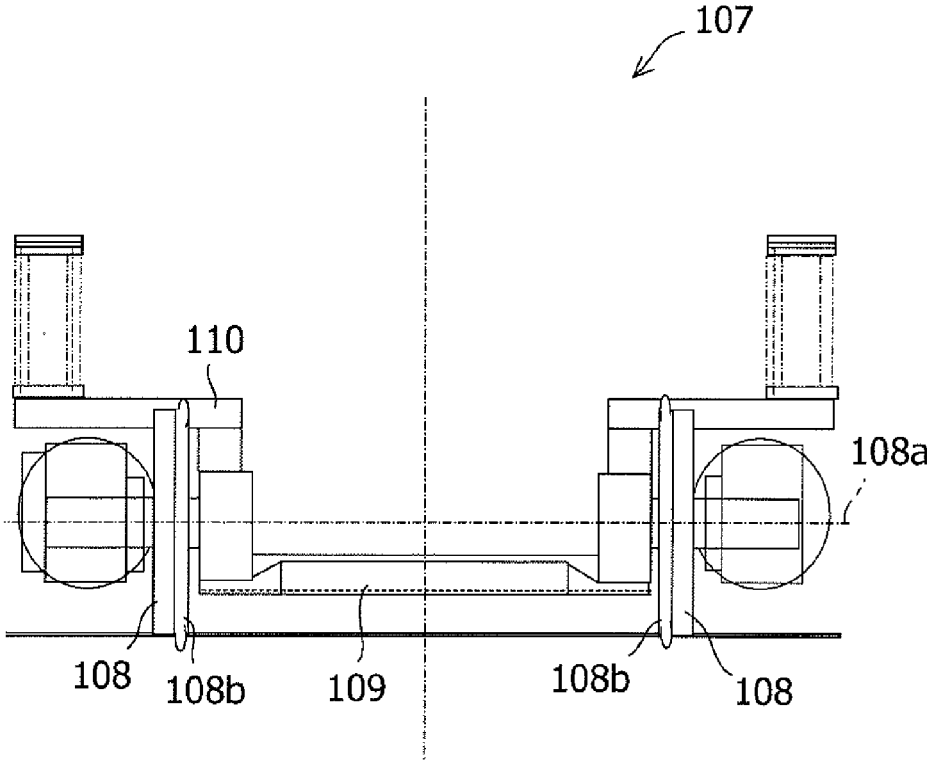
FIG. 16 is a front view schematically showing the truck of the conventional low floor vehicle.

Referring to FIG. 12, after the vehicle smoothly travels on the right-curved track which has the curvature radius equal to or less than R100 (S9), the first switch 52 is turned off (S10), the actuator 51 returns to the neutral state in the front vehicle 2 on the vehicle front side (S11), and the journal members 10 on the vehicle front side and the vehicle rear side, return to the state during the linear track traveling (S12).

Furthermore, the third switch 54 is turned off (S13), the actuator 51 returns to the neutral state in the front vehicle 2 on the vehicle rear side (S14), and the journal members 10 on the vehicle front side and the vehicle rear side return to the state during the linear track traveling (S15). As a result, the vehicle smoothly exits the right-curved track which has the curvature radius equal to or less than R100 (S16) and travels on the linear track again (S17).

On the other hand, referring to FIG. 11, if the curvature radius R of the curved track is equal to or greater than R100 and the first switch 52 is kept off (S3), the actuator 51 keeps the neutral state in the front vehicle 2 on the vehicle front side (S18). If the curvature radius R of the curved track is equal to or greater than R100 and the third switch 54 is kept off (S6), the actuator 51 keeps the neutral state in the front vehicle 2 on the vehicle rear side (S19). As a result, the vehicle smoothly passes on the right-curved track which has the curvature radius equal to or greater than R100 (S20).

Referring to FIG. 12, even after the vehicle smoothly passes on the right-curved track which has the curvature radius equal to or greater than R100 (S20), the actuator 51 keeps the neutral state in the front vehicles 2 on the vehicle front side and the vehicle rear side (S21). As a result, the vehicle smoothly exits the right-curved track which has the curvature radius equal to or greater than R100 and travels on the linear track again (S17).

The control flow in the case in which the vehicle passes on the left-curved track curving to the traveling direction left side, is explained.

Referring to FIG. 11, from a state in which the front vehicle 2 on the vehicle front side is traveling on the linear track (S1), when the vehicle enters the right-curved track (S22), if the curvature radius R of the curved track is equal to or less than R100, the second switch 53 is turned on, and on the other hand, if the curvature radius R of the curved track is equal to or greater than R100, the second switch 53 is kept off (S23). If the curvature radius R of the curved track is equal to or less than R100 and the second switch 53 is turned on (S23), the actuator 51 performs the expansion operation in the front vehicle 2 on the vehicle front side (S24), the journal member 10 on the vehicle front side turns to the left, and the journal member 10 on the vehicle rear side turns to the right (S25).

Furthermore, when the front vehicle 2 on the vehicle rear side enters the left-curved track, if the curvature radius R of the curved track is equal to or less than R100, the fourth switch 55 is turned on, and on the other hand, if the curvature radius R of the curved track is equal to or greater than R100, the fourth switch 55 is kept on (S26). If the curvature radius R of the curved track is equal to or less than R100 and the fourth switch 55 is turned on (S26), the actuator 51 performs the expansion operation in the front vehicle 2 on the vehicle rear side (S27), the journal member 10 on the vehicle front side turns to the left, and the journal member 10 on the vehicle rear side turns to the right (S28). As a result, the vehicle smoothly passes on the left-curved track having the curvature radius equal to or less than R100 (S29).

Referring to FIG. 12, after the vehicle smoothly travels on the left-curved track having the curvature radius equal to or less than R100 (S29), the second switch 53 is turned off (S30), the actuator 51 returns to the neutral state in the front vehicle 2 on the vehicle front side (S31), and the journal members 10 on the vehicle front side and the vehicle rear side, return to the state during the linear track traveling (S32).

Furthermore, the fourth switch 55 is turned off (S33), the actuator 51 returns to the neutral state in the front vehicle 2 on the vehicle rear side (S34), and the journal members 10 on the vehicle front side and the vehicle rear side, return to the state during the linear track traveling (S35). As a result, the vehicle smoothly exits the left-curved track which has the curvature radius equal to or less than R100 (S36) and travels on the linear track again (S17).

On the other hand, referring to FIG. 11, if the curvature radius R of the curved track is equal to or greater than R100 and the second switch 53 is kept off (S23), the actuator 51 keeps the neutral state in the front vehicle 2 on the vehicle front side (S18). If the curvature radius R of the curved track is equal to or greater than R100 and the third switch 54 is kept off (S26), the actuator 51 keeps the neutral state in the front vehicle 2 on the vehicle rear side (S19). As a result, the vehicle smoothly passes on the left-curved track having the curvature radius equal to or greater than R100 (S20).

Referring to FIG. 12, even after the vehicle smoothly passes on the left-curved track which has the curvature radius equal to or greater than R100 (S20), the actuator 51 keeps the neutral state in the front vehicles 2 on the vehicle front side and the vehicle rear side (S21). As a result, the vehicle smoothly exits the left-curved track having the curvature radius equal to or greater than R100, and travels on the linear track again (S17).

As explained above, according to the vehicle in the fourth embodiment of the present invention, effects the same as those in the second embodiment are obtained. In addition, the pivotal movement of the first stub link 21 and the third stub link 25 can be controlled by the actuator 51. Therefore, for example, by the operation of the actuator 51 corresponding to the curved track, it is possible to cause the wheels 8 which are linked to the first stub link 21 and the third stub link 25, to more surely enter the curved track at a small attack angle.

The embodiments of the present invention have been explained. However, the present invention is not limited to the embodiments explained above. Various modifications and alterations are possible on the basis of the technical concept of the present invention.

For example, as a first modification of the embodiments of the present invention, regarding composition of the vehicle according to the first to fourth embodiments, the number of front vehicles 2 and the number of intermediate vehicles 3 may be different from those in the embodiments as long as the trucks 7, are provided in the front vehicles 2, and the one intermediate vehicle 3 is arranged between the two front vehicles 2. Effects that are the same as the effects explained in the embodiments can be obtained.

As a second modification of the embodiments of the present invention, in the third embodiment and the fourth embodiment, rubber vibration insulators may be provided instead of the guide washers 45 of the restoring rod 41. Furthermore, it is possible to absorb vibration of the first stub link 21 and the third stub link 25. It is possible to effectively prevent deflection from occurring for the journal members 10 and the wheels 8 on the basis of this vibration.

As a third modification of the embodiments of the present invention, in the fourth embodiment, a control operation amount of the actuator 51 may be changed so as to correspond to the curvature radius R of the curved track. Since the wheels 8 more surely run along the curved track, the vehicle can more smoothly travel on the curved track.

As a fourth modification of the embodiments of the present invention, in the fourth embodiment, timing in which the actuator 51 operates may be set to correspond to a traveling route in advance, and the operation of the actuator 51, may be controlled to correspond to the set timing. Since the wheels 8 more surely run along the curved track, the vehicle can travel more closely along the track.

REFERENCE SYMBOL LIST

1 Track
2 Front vehicle
3 Intermediate vehicle
4 Connecting section
5 Pin connector
6 Vehicle body
7 Truck
8 Wheel
8*a*, 8*c*, 8*d* Axis
8*b* Wheel flange

9 Truck frame
9*a* Truck frame lateral beam
9*b* Truck frame longitudinal beam
10 Journal member
11 Conical rubber
12 Stub link
12*a* End
12*b* Axis
13, 29 Intersection
14 Middle point
15, 30 Stopper member
15*a*, 30*a* Stopper rubber
21 First stub link
22 Pivotal arm section
22*a* End
22*b* Axis
23 Interlocking lever section
23*a* Coupling pin
24 Second stub link
24*a* End
24*b* Axis
25 Third stub link
26 Pivotal arm section
26*a* End
26*b* Axis
27 Interlocking lever section
27*a* Long hole
28 Fourth stub link
28*a* Ends
28*b* Axis
41 Restoring rod
42 Piston rod
42*a* Head section
42*b* Cap section
42*c* Rod section
43 Cylinder
43*a* Recessed section
44 Coil spring
45 Guide washer
51 Actuator
52 First switch
53 Second switch
54 Third switch
55 Fourth switch
A, B, C Arrow
O Center
α, β, θ Angle

The invention claimed is:

1. A low floor vehicle comprising:

a truck provided under a vehicle body;

a truck frame configured as a frame member of the truck;

a pair of wheels configured to be pivotable independently from each other around the same axis which extends in a vehicle width direction, and configured to travel on a track;

a journal member which couples the pair of wheels and is attached to the truck frame; and a truck frame lateral beam arranged along the vehicle width direction in a position closer to a center of a vehicle longitudinal direction of the truck frame than the journal member, wherein the pair of wheels, the journal member, and the truck frame lateral beam, are provided on each of a vehicle front side and a vehicle rear side of the truck;

wherein the low floor vehicle includes:

a first stub link including a pivotal arm section which extends between the journal member and the truck frame lateral beam on the vehicle front side, and an interlocking lever section which extends along the vehicle longitudinal direction from the truck frame lateral beam toward a center of the truck frame;

a second stub link extending between the journal member and the truck frame lateral beam on the vehicle front side;

a third stub link including a pivotal arm section which extends between the journal member and the truck frame lateral beam on the vehicle rear side and an interlocking lever section which extends along the vehicle longitudinal direction from the truck frame lateral beam toward the center of the truck frame, and being arranged to be opposed to the first stub link; and a fourth stub link extending between the journal member and the truck frame lateral beam on the vehicle rear side, and being arranged to be opposed to the second stub link;

wherein an axis through both ends of the pivotal arm section of the first stub link and an axis through both ends of the second stub link are tilted such that a distance therebetween in the vehicle width direction is increased from the truck frame lateral beam toward the journal member;

wherein an axis through both ends of the pivotal arm section of the third stub link and an axis through both ends of the fourth stub link are tilted such that a distance therebetween in the vehicle width direction is increased from the truck frame lateral beam toward the journal member;

wherein both ends of the pivotal arm sections of the first stub link and the third stub link and both ends of the second stub link and the fourth stub link, are respectively attached to the journal member and the truck frame lateral beam so as to be pivotable around an axis extending in a vehicle height direction;

wherein coupling pins are provided at one distal end of the interlocking lever sections in the first stub link and the third stub link;

wherein long holes extending in the vehicle longitudinal direction, are provided at the other distal end of the interlocking lever sections in the first stub link and the third stub link; and wherein the coupling pins and the long holes engage with each other, whereby the first stub link and the third stub link are configured to be pivotable in synchronization with each other.

2. A low floor vehicle according to claim 1, wherein a restoring rod or a horizontal damper arranged along the vehicle width direction and configured to be retractable in the vehicle width direction, is provided in the truck, one end of the restoring rod or the horizontal damper is attached to one of the interlocking lever sections in the first stub link and the third stub link, and the other end of the restoring rod or the horizontal damper is attached to the truck frame.

3. A low floor vehicle according to claim 1, wherein an actuator arranged along the vehicle width direction and configured to be capable of reciprocatingly moving in the vehicle width direction, is provided in the truck, one end of the actuator is attached to one of the interlocking lever sections in the first stub link and the third stub link, the other end of the actuator is attached to the truck frame, and an operation of the actuator is controlled according to a linear track traveling state of the vehicle and a curved track traveling state of the vehicle, whereby the journal member is configured to be capable of turning with respect to the truck frame.

* * * * *